US006353720B1

(12) United States Patent
Sakai et al.

(10) Patent No.: US 6,353,720 B1
(45) Date of Patent: Mar. 5, 2002

(54) IMAGE DEVELOPING DEVICE USING A TONER AS A DEVELOPER

(75) Inventors: Takashi Sakai, Kitakatsuragi-gun; Takayuki Yamanaka, Tenri; Atsushi Inoue, Ikoma-gun; Jitsuo Masuda, Yamatotakada, all of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/684,936

(22) Filed: Oct. 6, 2000

(30) Foreign Application Priority Data

Oct. 7, 1999 (JP) ..... 11-286323
Nov. 11, 1999 (JP) ..... 11-320658

(51) Int. Cl.[7] ..... G03G 15/08

(52) U.S. Cl. ..... 399/234; 399/235; 399/281; 399/283

(58) Field of Search ..... 399/55, 98, 99, 399/228, 234, 235, 279, 281, 283, 284, 285

(56) References Cited

U.S. PATENT DOCUMENTS 5,164,773 A 11/1992 Nishio et al. ..... 399/283
5,897,243 A * 4/1999 Komatsubara et al. ..... 399/98
6,151,475 A * 11/2000 Uno ..... 399/283

FOREIGN PATENT DOCUMENTS

JP 2-116872 A 5/1990
JP 2-278273 * 11/1990
JP 3-033776 A 2/1991
JP 5-113714 A 5/1993

* cited by examiner

*Primary Examiner*—Joan Pendegrass

(57) ABSTRACT

A developing device, includes; a developing roller supporting and conveying mono component toner to a photoreceptor having a static latent image; a supplying roller pressed against the developing roller and rotated so as to supply the toner to the developing roller. In order to perform beneficial supply of the toner to the developing roller, bias voltages are applied so as to generate an electric field which will cause the toner between the developing roller and the supplying roller to be attracted to the developing roller. At a predetermined time before completion of development, the bias voltage applied to the supplying roller is switched so as to create an electric field which will cause the toner to be attracted to the supplying roller. Thus the toner residing between the developing roller and supplying roller after development is removed, whereby it is possible to prevent toner from sticking to that area on the developing roller, after development. Another configuration further includes a cleaning roller abutted on the supplying and regulating rollers. When development is completed, rotation of the developing roller is stopped. In time with this, the supplying roller, regulating roller and cleaning roller are kept on rotating for a predetermined period while the bias voltages are switched so that the direction of the electric fields acting on the toner, formed between the rollers after switching are opposite to those formed during development.

10 Claims, 14 Drawing Sheets

IMAGE DEVELOPING DEVICE USING A TONER AS A DEVELOPER

BACKGROUND OF THE INVENTION (1) Field of the Invention

The present invention relates to an developing device which performs development of the static latent image formed on the static latent image bearer with a toner as the coloring agent, and in particular, relates to a developing device using a developer as the toner composed of a single component.

(2) Description of the Prior Art

An image forming apparatus using electrophotographic technology, such as a copier, printer, etc. has a developing device which, in order to visualize the static latent image formed on the photoreceptor surface as a latent image bearer, etc., supplies a developer, such as toner or other coloring agents, to the photoreceptor and allows the toner to selectively adhere to the latent image.

In this developing device, the static latent image formed on the photoreceptor is developed and then the developed toner image is transferred to a sheet of paper as the printing material. On passing the transfer step, part of the toner which could not transfer to the sheet remains on the photoreceptor surface. This unnecessary leftover toner is removed from the photoreceptor surface in order to perform a subsequent image forming operation. Therefore, a cleaning device for removal of the leftover toner from the photoreceptor surface is arranged downstream of the transfer station, and the unnecessary toner removed by this cleaning device is collected into the collecting portion in the cleaning device.

With a trend of image forming apparatuses having a developing device of the above type toward being compact, the space for arrangement of the processing devices for image formation around the photoreceptor needs to be reduced. So there has been also a strong demand for a compact developing device.

Instead of using a dual component developer made up of a toner and a magnetic carrier, developing devices which use a mono component developer have been proposed and come into practice. In such a developing device using a mono component toner, there is no longer any necessity to control the toner concentration, and the volume of the developer hopper can be markedly reduced because of the absence of carrier, making it possible to make the developing device compact. In addition, the mono component toner developing device is simple and excellent in maintenance. Specifically, there is no need to replace the developer because of degradation of the developer, especially degradation of the carrier, so that maintenance for its replacement is unnecessary.

Control as to the toner also can be simplified because only the toner needs to be re-supplied while neither toner concentration detection and hence nor its control will be needed. Particularly, in a developing device using a mono component toner, the only thing to be done is to re-supply the toner when it is needed.

For example, as shown in FIG. 4, opposed to a photoreceptor 1 as an image bearer is a developing device 4 for visualizing the static latent image formed on photoreceptor 1. In this developing device 4, a rotatable developing roller 41 is arranged so as to oppose the opening of a developer hopper 40 holding a toner 10, the mono component developer. This developing roller 41 is exposed in part to the opening of developer hopper 40 and arranged in such a manner as to be in contact with photoreceptor 1, for example. This contact area will be the developing area.

Developing roller 41 supports the mono component toner on the surface thereof and conveys it to the developing area opposing photoreceptor 1. After development, the toner which has not been used for development is conveyed into developer hopper 40 and collected therein. The collected toner is once removed from the developing roller 41 surface. For this purpose, a supplying roller 42 is provided in pressing contact with developing roller 41 so as to scrape the toner supported on the developing roller 41 surface. This supplying roller 42 also functions to newly supply the toner to the developing roller 41 surface.

The mono component toner is supplied by supplying roller 42 and adheres to the developing roller 41 surface. In order to regulate the amount of adherence, a regulating means 43 is arranged in pressing contact with the developing roller 41 surface. The toner after having passed through regulating means 43 is regulated as to its amount and reaches the developing area where the toner opposes and is in contact with photoreceptor 1 as stated above. In this area, the toner selectively adheres to the static latent image formed on the photoreceptor 1 surface, thus development is carried out. The developing device having this configuration is disclosed in, for example, Japanese Patent Application Laid-Open Hei 3 No.33776.

In this disclosure, as the above regulating element 43, a plate-like element, instead of a roller configuration shown in FIG. 4, is provided so as to abut developing roller 41. In such a configuration, the life of a plate-like regulating element 43 is determined dependent on the degree of abrasion at the contact portion at which the element abuts developing roller 41. This contact portion comes in sliding contact with developing roller 41 while developing roller 41 rotates, and it is abraded by this contact. When the contact portion has become unusable because of the progress of abrasion, it is understood as the end of life of the regulating element 43. Since in a plate-like regulating element 43, the element is in contact with, and abraded by, the peripheral surface of developing roller, continuously at the unchanged, contact portion, the element becomes badly worn out.

Use of a plate-like element as regulating element 43 makes it possible to provide a simple configuration and reduce the cost, however suffers from marked abrasion at the contact portion with developing roller 41 as stated above. This further leads to liability to cause toner sticking at the contact portion of regulating element 43 with developing roller 41. When the toner sticks to an area, the amount of adherence on developing roller 41 at that area, differing from that in the other areas, becomes extremely low or becomes locally high, bringing about imbalance in the distribution of the toner layer thickness. This results in white stripes or black stripes attributed to the development.

Accordingly, the problem is the shortening of the life of regulating element 43 due to deficiencies of abrasion and toner sticking. This problem has been conventionally solved by providing a roller type regulating element 43 disclosed in Japanese Patent Application Laid-Open Hei 2 No.116872 and shown in FIG. 4. That is, the regulating element is avoided from abutting developing roller 41 at a fixed contact so as to reduce toner sticking and realize a longer life.

The use of regulating element 43 having a roller configuration consequentially stabilizes the amount of toner adherence on developing roller 41 and beneficially prevents unevenness in the amount of charge on the toner, providing the effect of stabilizing the development. However, the problem of toner sticking still occurs even using such regulating element 43 of a roller configuration. For example, when the development with the developing roller has been completed, the toner deposited on the developing roller is pressed by the regulating roller that is pressed against the developing roller as the toner moves together with the developer roller. During this period this, i.e., during development, the developing roller has a bias voltage applied thereto which causes the toner to be attracted toward the developing roller surface. Thus, any combination of these may cause toner to stick on the developing roller.

In the developing roller configured as in FIG. 4, the same phenomenon as in the position of regulating element will occur at the position of supplying roller 42. Actually, supplying roller 42 also is rotated with it also being abutted against developing roller 41 so as to supply the toner to developing roller 41 whilst scraping the toner after development. When developing roller 41 stops as the development is completed, supplying roller 42 is also stopped. Therefore, the toner held at that nip between the rollers may stick to the developing roller 41 surface or the supplying roller 42 surface.

Once the toner has stuck to the developing roller 41 surface, not only the development conditions change, presenting deficiency in development but also the toner is unevenly applied on the developing roller 41 surface, forming stripes, white voids during development thus degrading the image quality.

For countermeasures against this, Japanese Patent Application Laid-Open Hei 5 No.113714, for example, discloses a configuration in which the developing roller is rotated in the reverse direction before the start of the developing action of the developing roller or after development, to prevent sticking of the toner to the developing roller etc. As the developing roller is rotated in the normal direction to perform development after this control, the toner layer deposited on the developing roller is made uniform in thickness to achieve beneficial development.

The above reverse rotation of the developing roller is effective in preventing toner adherence and sticking to the developing roller, but if it is done before development, this naturally delays the start of development or the start of image formation. Therefore, it is preferable to remove the toner adhering on the developing roller by reversing the developing roller after development and have the apparatus ready for a next operation with toner sticking prevented.

However, trying to remove the unnecessary toner adhering on the developing roller at the position of the regulating element by reversing the developing roller cannot present good enough scraping effect. Further, in the case where the developing roller is reversed, there is a risk that the toner having been scraped off by the regulating element cannot be collected inside the developing hopper and might scatter outside the developing hopper.

Moreover, in a configuration where contact development is employed or the developing roller is set in contact with the photoreceptor as a static latent image bearer, if the scheme of reversing the developing roller is adopted, frictional force etc. acting on the photoreceptor causes rather severe damage to the photoreceptor. Actually, in the system where the damage to the photoreceptor due to the rotation during the developing action is minimized, if the rotation is reversed, abrasion on and damage to the photoreceptor surface are increased, shortening the life of the photoreceptor. Further, since an extra driving mechanism is needed to rotate the developing roller in the reverse direction, this increases the cost from both the structural and control aspects.

In this way, the configuration where the developing roller is rotated in reverse is effective when it is applied to a developing unit with its developing roller kept out of contact with the photoreceptor, while it is not very effective if it is applied to a developing unit with its developing roller kept in contact with the photoreceptor.

In the aforementioned developing unit disclosed in Japanese Patent Application Laid-Open Hei 2 No.116872, a cleaning blade with its distal end abutted against the regulating roller is provided so as to scrape (clean) the toner adhering on the regulating roller, whereby the toner layer deposited on the developing roller is made uniform. Since this configuration makes it possible to remove the toner adhering to the regulating roller by means of the blade, the problem of toner sticking and others can be eliminated to a certain degree.

However, the above configuration where the regulating element is provided in a roller form as regulating roller 4 with a cleaning blade for scraping the adhering toner, needs the pressing condition of the cleaning blade correctly setting, etc., requiring very burdensome adjustment and tasks. In particular, the increase in contact pressure in order to enhance the cleaning effect results in the risk of the regulating roller surface being damaged, while no cleaning effect can be expected if the contact pressure is too small.

Thus, since the cleaning blade is provided to scrape the toner remaining on the regulating roller surface, this configuration makes it possible to avoid the toner from being pressed between the developing roller and the regulating roller at the end of development and hence it is possible to inhibit such toner from sticking in a limited degree, but the adjustment task becomes very burdensome as stated above.

In addition,.even if the regulating roller surface is cleaned and the toner is regulated so as to be uniform by abutting the cleaned, regulating roller against the developing roller, the developing roller is supplied with the toner for development by means of the supplying roller. That is, the amount of the supplied toner is limited by the regulating roller but the toner inevitably exists between the regulating roller and the developing roller when the rollers are stopped at the end of development. Therefore, if the machine is left for a long time with the toner squeezed therebetween, it is impossible to effectively solve the toner sticking and other problems.

Moreover, the toner sticking problem occurs not only between the regulating roller and the developing roller, but also occurs between developing roller and the supplying roller. In conclusion, prevention against toner sticking cannot be essentially eliminated even if the above configuration where a cleaning blade is provided for the regulating roller, as disclosed in the above publication, is employed as stated above.

SUMMARY OF THE INVENTION

It is therefore an object of the present invention to provide a developing unit using a mono component toner, having a supplying roller for supplying the toner to the developing roller, which effectively prevents toner sticking to the developing roller and other components without causing any damage to the static latent image bearer, any toner scattering and any undesirable effects.

It is another object of the present invention to provide a suitable means for eliminating the toner sticking problem with developing units, not limited to those using a developing roller kept out of contact with the static latent image bearer but also applicable to those using a contact type developing roller.

It is a further object of the present invention to a developing unit in which rotations of the regulating roller and supplying roller after development are controlled so as to remove the toner existing between the developing roller and these rollers, whereby the cause of toner sticking is eliminated.

In order to achieve the above objects, the present invention is configured as follows:

In accordance with the first aspect of the present invention, a mono component toner developing device, includes: a developing roller supporting and conveying the mono component toner to a developing area opposing a static latent image bearer; a supplying roller for supplying the toner to the developing roller, as the preparative stage for facilitating the developing roller to convey the toner to the developing area; and a controller which controls the bias voltages to the developing roller and supplying roller so that the potential difference therebetween during development creates an electric field that will cause the toner to move toward the developing roller side, switches the bias voltages, at the timing when the static latent image on the static latent image bearer is completely developed passing through the developing area, so that the polarity of the potential difference between the rollers becomes reversed compared to that during development, and keeps the potential difference during a predetermined period of time (t1) up to the rotation stop of the developing roller for terminating the developing operation.

In accordance with the second aspect of the present invention, the mono component toner developing device having the above first feature is characterized in that the controller switches the bias voltage applied to the supplying roller from the voltage during development to such a voltage that the potential difference between the supplying roller and developing roller becomes reversed compared to that during development.

In accordance with the third aspect of the present invention, the mono component toner developing device having the above first feature is characterized in that the controller stops rotation of the developing roller after a lapse of the predetermined time (t1), keeps up the drive of the supplying roller for a fixed period of time whilst maintaining the reversed state of the potential difference between the supplying roller and developing roller, and stops all the rollers and their voltage application after a lapse of the fixed time.

In accordance with the fourth aspect of the present invention, the mono component toner developing device having the above first feature is characterized in that the potential difference between the developing roller and supplying roller during development and that after the switching control following the development are set to be lower than the discharge starting voltage.

In accordance with the fifth aspect of the present invention, the mono component toner developing device having the above first feature is characterized in that the predetermined time (t1) is set so as to at least allow the developing roller to rotate more than one revolution.

In accordance with the sixth aspect of the present invention, a mono component toner developing device, includes: a developing member (roller) supporting and conveying the mono component toner to a developing area opposing a static latent image bearer; a supplying roller for supplying the toner to the developing roller, as the preparative stage for facilitating the developing roller to convey the toner to the developing area; a regulating roller for limiting the toner supplied to the developing roller to a constant amount before the toner reaches the developing area; a cleaning roller disposed in contact with the supplying roller and the regulating roller; and a controller which stops the developing member after the static latent image on the static latent image bearer has been developed whilst keeping on the rotation of supplying roller, regulating roller and cleaning roller for a predetermined period of time, and switches the levels of the bias voltages, in time with the stop control of the developing member so that the directions of the electric fields acting on the toner, formed at least between the developing member and the supplying roller and between the developing member and the regulating roller after switching are opposite to those formed during development.

In accordance with the seventh aspect of the present invention, the mono component toner developing device having the above sixth feature is characterized in that the controller switches the level of the bias voltage applied to the cleaning roller so that the directions of the electric fields acting on the toner, formed between the supplying roller and the cleaning roller and between the regulating roller and the cleaning roller after switching are opposite to those formed during development.

In accordance with the eighth aspect of the present invention, the mono component toner developing device having the above sixth or seventh feature is characterized in that upon the switching control of the bias voltages, the controller regulates the potential differences to be equal to or lower than the discharge starting voltage.

In accordance with the ninth aspect of the present invention, the mono component toner developing device having the above sixth feature is characterized in that the controller stops rotation of the supplying roller and regulating roller after a lapse of the predetermined period of time and keeps on controlling and driving only the cleaning roller for a predetermined period of time.

In accordance with the tenth aspect of the present invention, the mono component toner developing device having the above ninth feature is characterized in that the controller turns off the application of voltages to the supplying roller and the regulating roller, or the application of voltages to the above two rollers and the cleaning roller, after a lapse of the predetermined period of time.

In accordance with the eleventh aspect of the present invention, the mono component toner developing device having the above sixth feature is characterized in that the predetermined time is set so as to at least allow the supplying roller, regulating roller and cleaning roller to rotate more than one revolution.

According to the developing device having the above first configuration, during the predetermined period of time (t1) before the completion of the developing operation, the potential difference between the developing roller and the supplying roller after switching is controlled so as to be opposite to that during development. That is, when the static latent image has been developed passing through the developing area, the potential difference is controlled during the predetermined period (t1) after the development so as to be reversed compared to that during development. This generates an electric field opposite to that during development, so as to cause the toner to transfer from the developing roller side to the supplying roller side instead of the toner being supplied from the supplying roller to the developing roller. Therefore, toner sticking to the developing roller can be inhibited. In addition, the supplying roller as it rotates without supplying the toner can scrape the toner adhering on the developing roller, enhancing the prevention effect against toner sticking to the developing roller.

In this case, the developing roller is kept on rotating as is and the supplying roller is also kept on rotating as is. So deficiencies which would occur if the developing roller was rotated in reverse will not occur. Thus, it is possible to inhibit occurrence of abrasion and damage to the photoreceptor as a static latent image bearer such as a photoreceptor having an organic photoconductive film (OPC).

Next, according to the above second aspect, in the developing device having the above first configuration, the controller switches the bias voltage applied to the supplying roller from the voltage during development to such a voltage that the potential difference between the supplying roller and developing roller becomes reversed compared to that during development. Therefore, the developing bias voltage applied to the developing roller can be kept as is. As a result, it is possible to prevent any unnecessary toner from adhering to the non-image area due to the developing roller rotation after development, still using a simple switching control configuration of switching the bias voltages.

Further, according to the above third aspect, in the developing device having the above first configuration, the controller stops rotation of the developing roller after a lapse of the predetermined time (t1), keeps up the drive of the supplying roller for a fixed period of time whilst maintaining the reversed state of the potential difference between the supplying roller and developing roller, and stops all the rollers and their voltage application after a lapse of the fixed time. Thus, since rotation of the supplying roller is kept on, the toner adhering on the supplying roller can be efficiently removed by the stationary developing roller. Therefore, this configuration inhibits toner adherence to the supplying roller and hence can inhibit sticking to the supplying roller, thus preventing toner sticking to the developing roller in an efficiently manner.

Moreover, according to the above fourth configuration, in the developing device having the above first configuration, the potential difference between the developing roller and supplying roller during development and that after the switching control following the development are set to be lower than the discharge starting voltage. This configuration can prevent occurrence of electric discharge which might occur during switching control etc. In particular, if discharge occurred, the toner would be heated and fused and might stick to the developing roller and supplying roller. This configuration can prevent occurrence of such events.

According to the above fifth configuration, in the developing device having the above first configuration, the predetermined time (t1) is set so as to at least allow the developing roller to rotate more than one revolution. Therefore, the entire peripheral surface of the developing roller can removed of the toner. For example, when the developing roller is adapted to rotate five or six revolutions, it is possible to almost exclude the toner from the nip between the developing roller and the supplying roller. Further, when the supplying roller is kept on rotating for a fixed period of time (t2) while the developing roller is stopped when the developing operation is completed, the fixed period of time should be set so as to at least allow the supplying roller to rotate more than one revolution. This enables removal of the toner from the entire surface of the supplying roller and resultantly enhances the prevention effect against toner sticking.

Next, according to the developing device having the above sixth configuration, the developing member is stopped when the developing operation is ended. In this case, the static latent image bearer is also stopped and the application of developing bias voltage during development is also turned off at the same time. This arrangement prevents the toner from transferring to the photoreceptor side. On the other hand, the supplying and regulating rollers are kept on rotating for a predetermined period of time and the levels of the bias voltages are shifted from those applied during development. Illustratively, during the developing operation, the bias voltages are applied so that the electric fields will cause the toner to move in the directions indicated by the arrows shown in FIG. 12A. In particular, in order to cause the toner to transfer to the developing member (41), the bias voltages applied to the supplying roller (42) and regulating roller (43) relative to the developing bias voltage are set so that the directions of the forces acting on the toner by the electric fields are oriented as indicated by the arrows. When the developing operation is completed and rotation of the developing member (41) is stopped, the levels of the bias voltages are switched from those during development to the different levels so that the electric fields will cause the toner to move to the supplying roller 42 and regulating roller 43 sides. In this way since the supplying roller and regulating roller are kept on rotating with the attractive and repulsive forces during development weakened, the toner adhering on the developing member is effectively removed. That is, the toner residing between the developing member and supplying roller and between the developing member and regulating roller can be positively removed and hence the toner to be trapped is excluded, thus eliminating the problem of toner sticking and making it possible to keep up the stable development in the long term.

Next, according to the above seventh aspect, in the developing device having the above sixth configuration, the controller switches the level of the bias voltage applied to the cleaning roller so that the directions of the electric fields acting on the toner, formed between the supplying roller and the cleaning roller and between the regulating roller and the cleaning roller after switching are opposite to those formed during development. Therefore, this configuration enhances the toner removal effect of excluding the toner from the nip between the cleaning roller (45) and supplying roller (42) and the nip between the cleaning roller (45) and regulating roller (43) as shown in FIG. 12B so as to eliminate the factor itself that will cause toner sticking, thus making it possible to keep up the stable development in the long term.

Further, according to the above eighth aspect, in the developing device having the above sixth or seventh configuration, upon the switching control of the bias voltages, the controller regulates the potential differences to be equal to or lower than the discharge starting voltage. Therefore, it is possible to prevent the toner from sticking due to heat which would be generated by the electric discharge current. That is, since the bias voltages is set so as not to cause discharge upon the switching control of the bias voltages when the developing operation is ended, it is possible to eliminate deficiencies due to electric discharge.

Moreover, according to the above ninth aspect, since in the developing device having the above sixth configuration, the controller stops rotation of the supplying roller and regulating roller after a lapse of the predetermined period of time and keeps on controlling and driving only the cleaning roller for a predetermined period of time, the toner adhering on the supplying roller and regulating roller which are both standing still can be removed by the cleaning roller. Thus, the toner residing at the areas in contact with the cleaning roller can be removed to thereby eliminate the factor of causing toner sticking and hence eliminate the deficiencies thereby.

Furthermore, according to the above tenth aspect, since in the developing device having the above sixth configuration, the controller turns off the application of voltages to the supplying roller and the regulating roller, or the application of voltages to the above two rollers and the cleaning roller, after a lapse of the predetermined period of time, it is possible to prevent the toner from fusing and sticking due to Joule heat which would be generated by micro current flowing between the rollers. In particular, the adhering toner when rotation of the supplying roller and regulating roller is stopped can be prevented from fusing from the aforementioned heat.

Finally, according to the above seventh aspect, since in the developing device having the above sixth configuration, the predetermined time is set so as to at least allow the supplying roller, regulating roller and cleaning roller to rotate more than one revolution, it is possible to remove the adhering toner from the entire peripheral surfaces of the rollers and hence completely exclude the toner remaining between the rollers. Therefore, it is possible to eliminate the cause of toner sticking. Thus, it is possible to eliminate development failures due to toner sticking and keep up the stable development in the long term.

DESCRIPTION OF THE PREFERRED EMBODIMENTS

Figure 1:
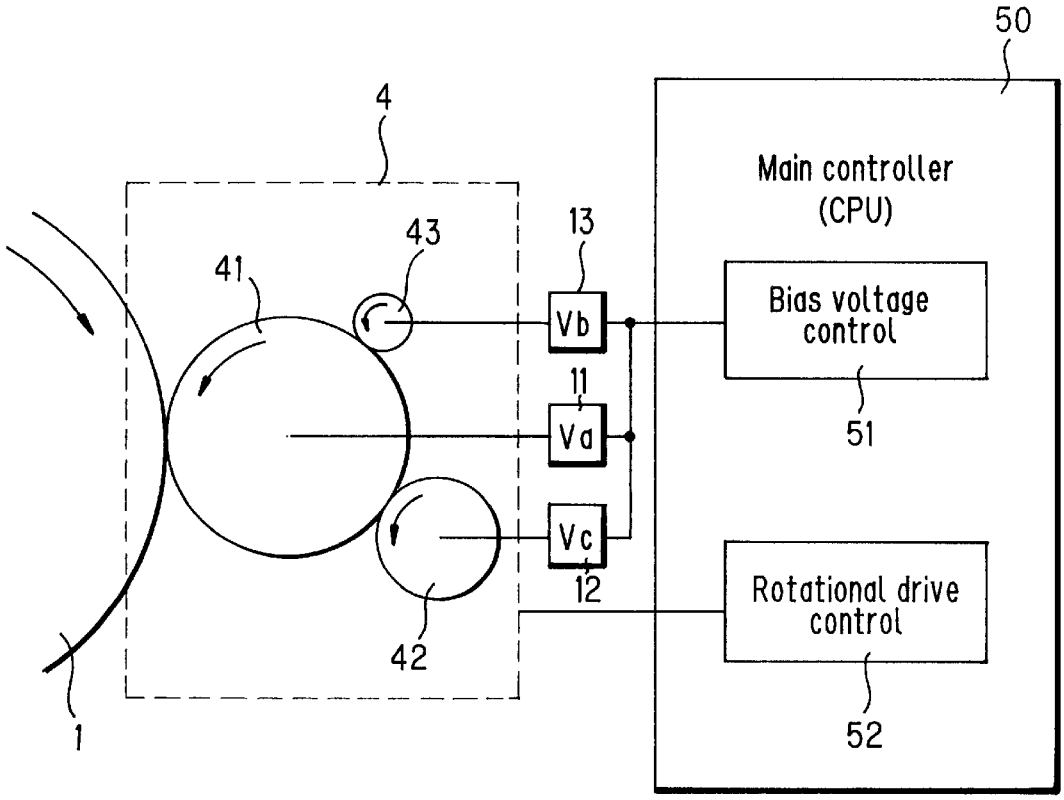
FIG. 1 is a diagram showing a control circuit configuration for illustrating an example of controlling a mono component toner developing device of the first embodiment of the present invention.
Figure 2:
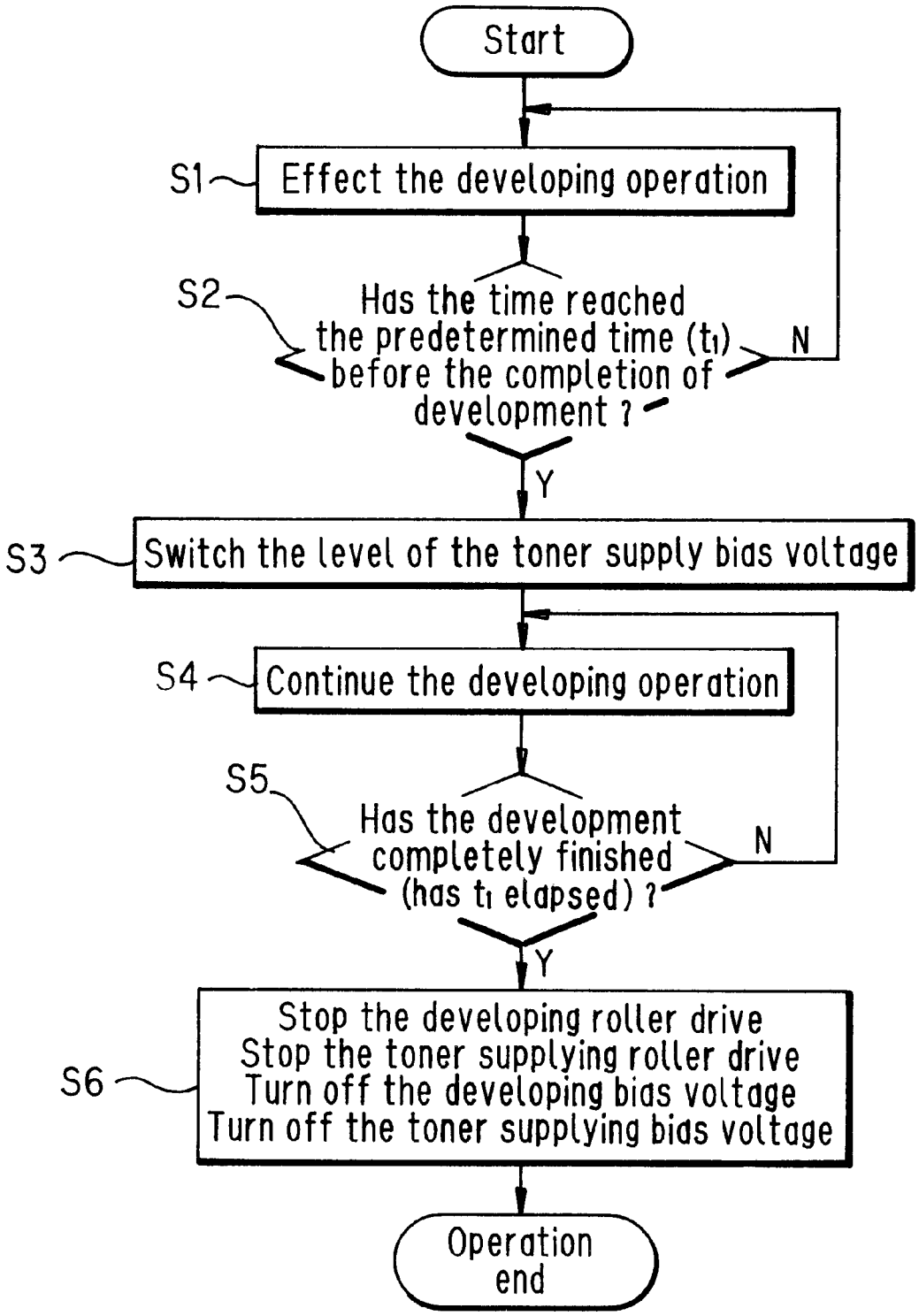
FIG. 2 is a control flowchart showing the control sequence of the control circuit configuration shown in FIG. 1, in particular, showing the control sequence of the developing device after the completion of development.
Figure 3A:
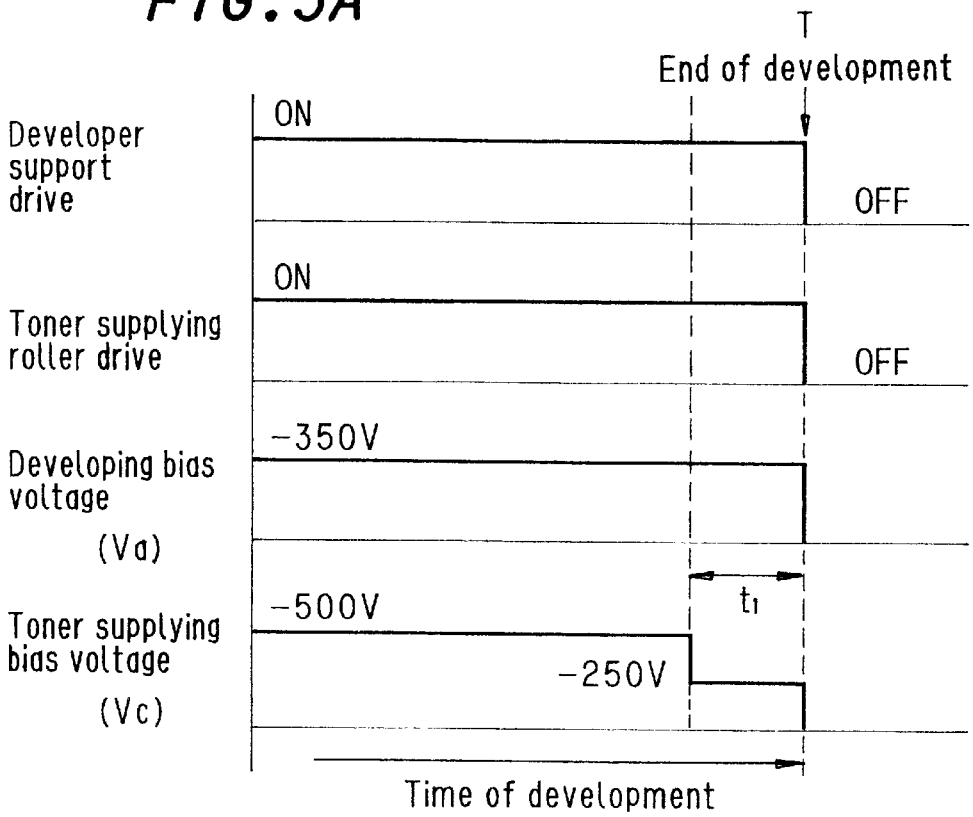
FIGS. 3A and 3B are timing charts showing the control timing in association with the control flowchart shown in FIG. 2, FIG. 3A showing a timing chart of the present invention and FIG. 3B showing a timing chart of a conventional configuration.
Figure 3B:
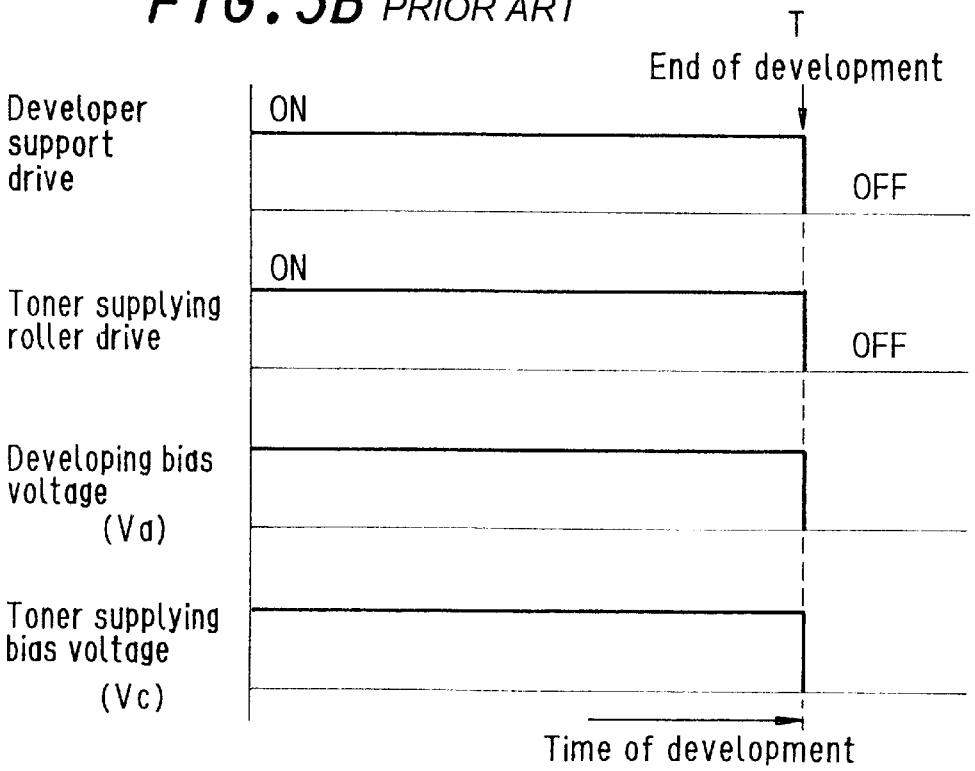
FIG. 3B PRIOR ART
Figure 4:
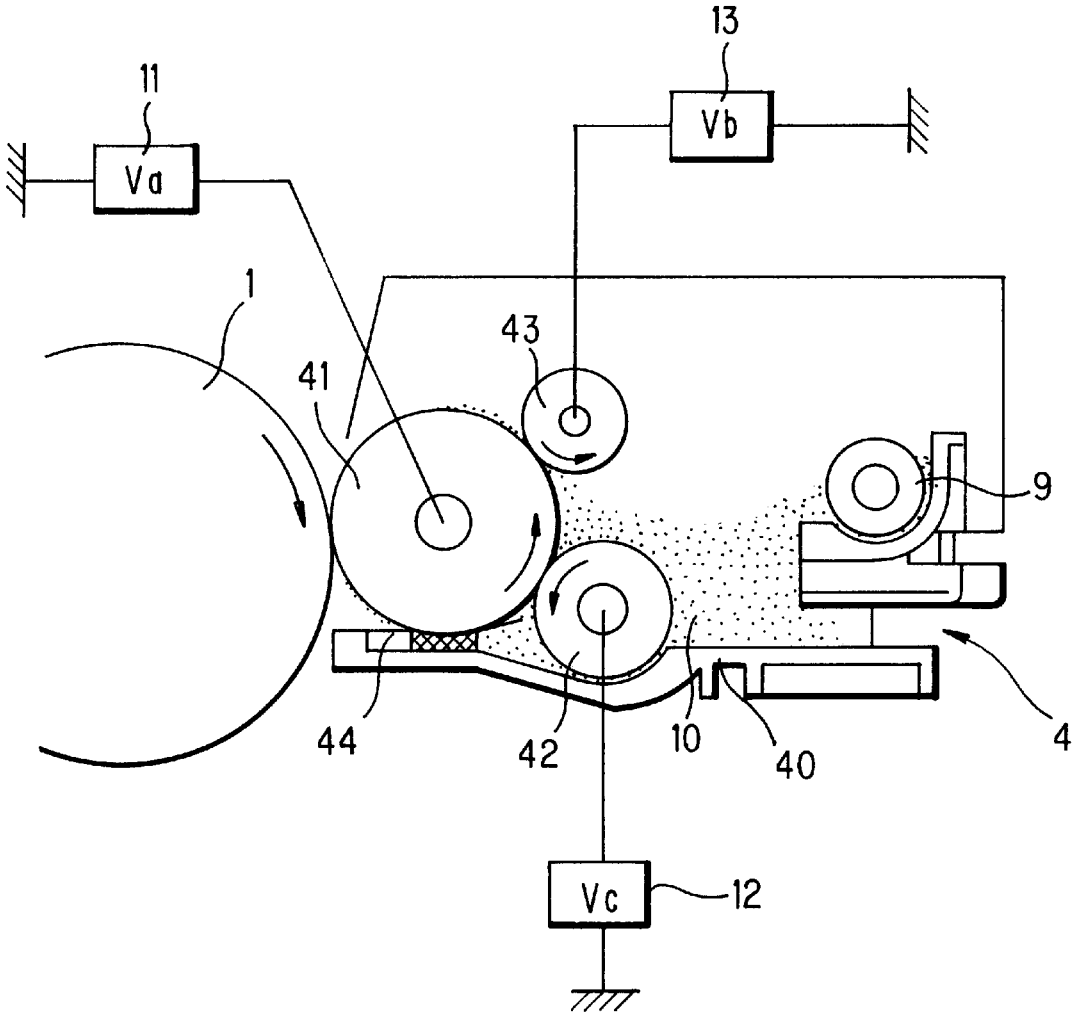
FIG. 4 is a view showing the internal configuration of a mono component toner developing device in accordance with the first embodiment of the present invention.
Figure 5:
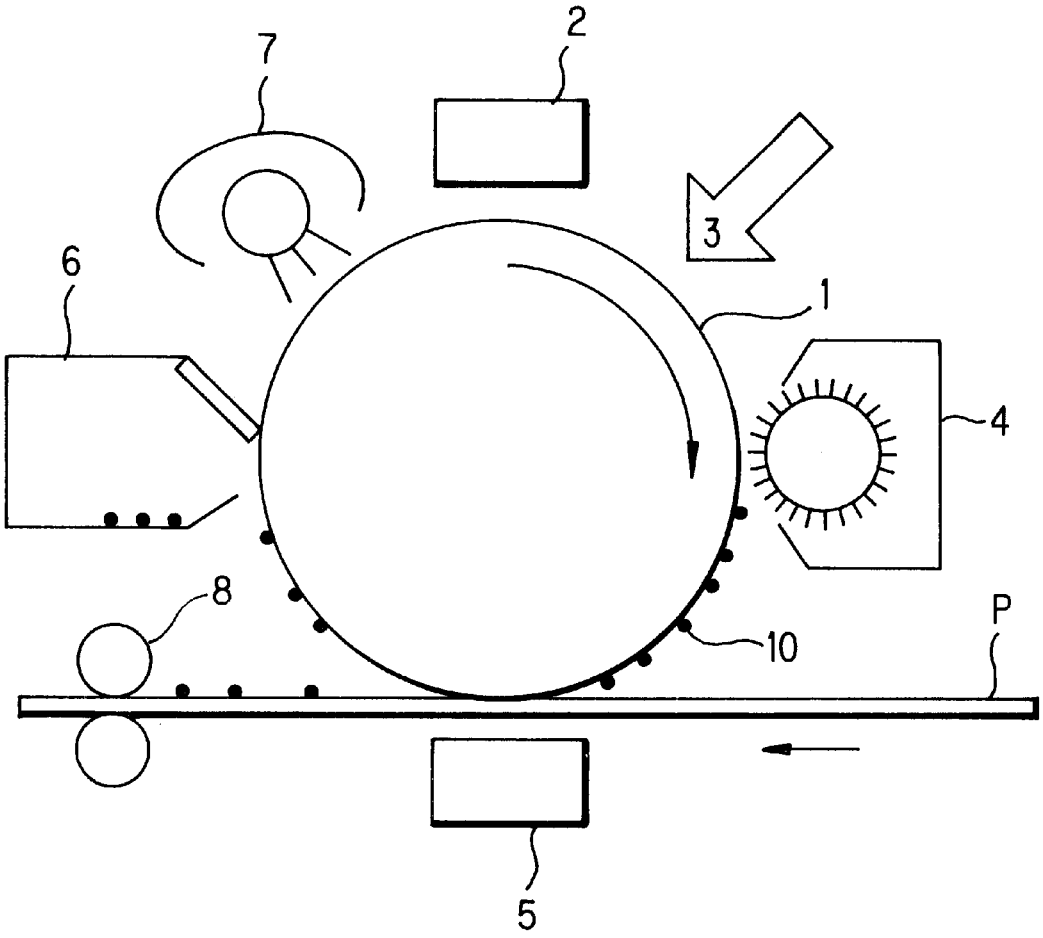
FIG. 5 is a view showing an overall configuration of an image forming apparatus with a developing device of the present invention.

The embodiments of the present invention will hereinafter be described in detail with reference to the accompanying drawings. One embodiment of a developing device of the present invention will be described with reference to FIGS. 1 through 4. FIG. 1 is a diagram showing the configuration of a developing device of the present invention including control circuits for voltage supply control and drive control. FIG. 2 is a control flowchart showing the control sequence of the developing device of the present invention shown in FIG. 1 especially after the completion of development. FIG. 3A is the timing chart therefore. FIG. 3B is conventional. FIG. 4 is a view showing the overall configuration of the developing device in accordance with the present invention. FIG. 5 is a view showing the overall configuration of an image forming apparatus with the developing device of the present invention.

Referring first to FIG. 5, the overall configuration of an image forming apparatus will be described. Designated at 1 is a drum shaped photoreceptor which is arranged in the approximate central portion of the image forming apparatus as an image bearer for supporting a static latent image formed thereon and is rotationally driven at a constant rate in the direction of the arrow during image forming. Various image forming processing means are arranged opposing and around this photoreceptor 1.

The means (devices) constituting the image forming process include: a charger 2 for uniformly charging the photoreceptor 1 surface; an unillustrated optical system radiating a light image 3 in accordance with the image to be formed; a developing device 4 of the present invention for visualizing the static latent image formed on the photoreceptor 1 surface by exposure of the optical system; a transfer device 5 for transferring the developed image (image of toner 10) to a sheet of paper P being conveyed as appropriate; a cleaning device 6 for removal of the leftover developer (toner) which has been untransferred and is residing on the photoreceptor 1 surface after transfer; and an erasing device 7 for eliminating static charge remaining on the photoreceptor 1 surface, all being arranged in the mentioned order with respect to the rotational direction of photoreceptor 1.

A large number of sheets P are stacked on a tray or cassette, for example, and the paper is fed one by one from the stack by means of a paper feeding means to the transfer area where the aforementioned transfer device 5 is arranged opposing photoreceptor 1 so that the leading edge of the sheet is registered with the leading edge of the toner image formed on the photoreceptor 1 surface. Sheet P after transfer is separated from photoreceptor 1 and fed into a fixing device 8.

Fixing device 8 fixes the unfixed toner image, just transferred onto the sheet, as a permanent image, and includes a heat roller, which faces the toner image surface and is heated to a temperature so as to fuse and fix the toner, and a pressing roller which is pressed against the heat roller so as to bring paper P into close contact with the heat roller. Paper P having passed through fixing device 8 is discharged by discharging rollers to an unillustrated output tray outside the image forming apparatus.

The aforementioned unillustrated optical system, if the image forming apparatus is a copier, illuminates the copy original with light so that the reflected light from the original is focused as light image 3 on the photoreceptor. Alternatively, when the image forming apparatus is a printer or a digital copier, the optical system radiates a light image by switching a semiconductor laser on and off in accordance with the image data. Particularly, in a digital copier, the reflected light from the copy original is picked up by an image pickup sensor (CCD elements, etc.) so that the picked up image data is Input to the optical system including a semiconductor laser, thus producing a light image corresponding to the image data. In a printer, the optical system converts the image data from another processor, e.g., a word processor, personal computer etc., into a light image, and irradiates the photoreceptor with it. The conversion into the light image can also be carried out by an LED device, liquid crystal shutter, etc., in place of a semiconductor laser.

In this arrangement, once an image forming operation is started in this image forming apparatus, photoreceptor 1 is rotationally driven in the direction of the arrow and the photoreceptor 1 surface is uniformly charged by charger 2 to a predetermined potential of a specified polarity. After charging, the aforementioned unillustrated optical system illuminates photoreceptor 1 with light image 3 so that a static latent image corresponding to the light image is formed on the photoreceptor 1 surface. This static latent image is visualized, or developed in the next step, i.e., by developing device 4. In this invention, development is carried out with a mono component toner and the toner is selectively attracted by static electric force, for example, to the static latent image formed on the photoreceptor 1 surface, thus the development is performed.

The developed toner image thus formed on photoreceptor 1 surface is electrostatically transferred to sheet P being conveyed as appropriate in synchronization with the rotation of photoreceptor 1, by transfer device 5 located in the transfer area. Transfer of the toner image to sheet P is carried out by transfer device 5 by supplying the rear side of sheet P with charge of a polarity opposite to that of the toner.

After transfer, part of the toner image has been untransferred and remains on the photoreceptor 1 surface. This leftover toner is removed by cleaning device 6 from the photoreceptor 1 surface. Then, the remaining charge on the photoreceptor 1 surface is erased to a uniform potential level, e.g., about 0 volt, by means of erasing device 7 for the next use of photoreceptor 1.

Sheet P after transfer is separated from photoreceptor 1 and conveyed to fixing device 8. In fixing device 8, the toner image on paper P is fused and pressed and fixed to paper P under the pressure acting between the rollers. The paper passing through fixing device 8 is discharged as an image formed sheet P to the output tray etc., arranged outside the image forming apparatus.

(The Developing Device of the Present Invention)

Referring next to FIG. 4, the configuration of the developing device of the present invention will be described. That is, a configurational example of a mono-component toner developing device of the present invention will be explained in detail.

To begin with, the structure of the developing device performing development with a mono component toner is described with reference to FIG. 4. Developing device 4 comprises: a developing roller 41 which is arranged rotatably in a developer hopper 40 holding a mono component toner, e.g., a non-magnetic mono component toner 10; and a supplying roller 42 for supplying mono component toner 10 to the developing roller 41 side. Further, arranged on the right side in the drawing of developer hopper 40 is a screw roller 9 which feeds mono component toner 10, re-supplied as necessary, into developing hopper 40. Developing roller 41 arranged inside developer hopper 40 is rotated so as to convey the toner to the aforementioned partially exposed, developing area opposing photoreceptor 1, in such a manner that the surface of the roller moves in the same direction as that of the movement of the photoreceptor 1 surface as shown in the figure. The aforementioned supplying roller 42 is put in pressing contact with developing roller 41 in the area opposite to the developing area.

Developing roller 41 is configured of, for example, a metal roller (including a rotational shaft) and a porous elastic material, such as sponge, coated on the surface of the metal roller. When highpolymer polyurethane foam with carbon dispersed therein or ion-conductive solid rubber is used for the elastic material such as sponge, the resistance of the roller surface can be maintained within a specified range which inhibits the occurrence of toner fusing etc., leading to advantages when the developing bias voltage is applied, as will be described later.

A specific example of the developing roller 41 configuration will be described. Developing roller 41 is composed of a stainless steel rotational shaft having a diameter of, for example, 18 mm and a conductive urethane rubber having a conductionizing agent such as carbon black added therein and having a volume resistivity of about $10^6$(Ωcm) and a JIS-A hardness of 60 to 70 degrees, coated on the shaft so that the roller has a diameter of 34 mm with a surface roughness of Rz=3 to 6 μm (conforming to JISB-0601) Developing roller 41 is put in pressing contact with photoreceptor 1 with a contact depth of 0.1 to 0.3 mm with a toner layer in between and is rotated in the direction of the arrow (in the counterclockwise direction) by an unillustrated driving motor. This developing roller 41 is controlled and driven with its peripheral speed set at 285 mm/sec. This is a mere example and the invention should not be limited to this.

A developing bias voltage Va is applied to developing roller 41 from a developing bias voltage power circuit 11 via the rotational shaft. This developing bias voltage Va is set at a voltage of a polarity so that the toner will adhere to the static latent image formed on photoreceptor 1 while the toner will not adhere to areas other than that, i.e., the non-image area. For example, when the mono component toner has a charge characteristic of negative polarity, the bias voltage is set at about −350 V, though it is dependent on the relationship with the surface potential of photoreceptor 1.

As the above developing roller 41 is rotationally driven, mono component non-magnetic toner 10 is attracted to the surface of rotating developing roller 41 and is conveyed to the developing area opposing the photoreceptor 1 surface. Since developing roller 41 is put in pressing contact with the photoreceptor 1 surface, the pressing contact area constitutes the developing area where mono component toner 10 is attracted to the static latent image on the photoreceptor 1 surface and thus the image is developed.

Mono component toner 10 is a mono component non-magnetic toner having a mean particle size of about 10 μm, for example, and is of a polyester toner or styrene acrylic toner. This toner size is a mere example and toner having a mean particle size of 8 μm, 6 μm or smaller is used for a high-resolution (600 dpi or 1200 dpi) development.

The mono component toner can be obtained by mixing 80 to 90 parts by weight of styrene-acrylic copolymer, 5 to 10 parts by weight of carbon black, and 0 to 5 parts by weight of a charge control agent, kneading the mixture, crushing and classifying, thus producing a negatively charged toner having a mean particle size of about 5 to 10 μm. In order to improve fluidity of this toner, 0.5 to 1.5 parts by weight of silica ($SiO_2$) is internally or externally added, thus producing the non-magnetic mono component toner.

The toner is not limited to a negatively charged type but a positively charged toner may be obtained. This can be easily obtained by appropriate selection of a main binder resin and charge control agent etc. The toner is not limited to black toner for monochrome copiers and printers but color toner for color copiers and printers may be used. Non-magnetic mono component toner is not limited to the above composition but the composition shown hereinbelow may be applicable to the developing device of the present invention.

As a thermoplastic resin for the main component binder resin, polystyrene, polyethylene, polyester, low-molecular weight polypropylene, epoxy, polyimide, polyvinyl butyral or the like may be used in place of styrene-acrylic copolymer.

As the coloring agent, furnace black, nigrosine dyes, metal contained dyes or the like may be used in place of carbon black in the case of a black toner. For color toner, examples for yellow toner include benzidine type yellow pigment, phonon-yellow, acetoacetic anilide type insoluble azo pigments, monoazo pigments, azomethine type dyes. Examples for magenta toner include xanthene type magenta dyes, phosphorous wolframate-molybdate lake pigments, anthraquinone type dyes, coloring material consisting of xanthene type dyes and organic carboxylic acid, thioindigo, Naphtol type insoluble azo pigments. Examples for cyan toner include copper phthalocyanine type pigments.

Examples of toner fluidizer include, other than silica as an external additive, colloidal silica, titanium oxide, alumina, zinc stearate, polyfluorovinylidene and combinations thereof.

Further, examples of charge control agents for negatively charged toner include azo type metal-contained dyes, organic acid metal complex and chlorinated paraffins. Examples for positively charged toner include nigrosine type dyes, fatty acid metallic salts, amines and quaternary ammonium salts.

Supplying roller 42 is rotationally driven in the counterclockwise direction in FIG. 4, or in such a direction that the surface of the supplying roller moves in the opposite direction as that of the movement of developing roller 41 surface, at the opposed area (pressing contact area) with developing roller 41. This supplying roller 42 has the function of supplying the toner to the developing roller and the functions of agitating toner 10 in developing hopper 40 and removing the toner remaining on the developing roller 41 after development. Supplying roller 42 is configured of a similar material to that of developing roller 41 and adjustment as to electric resistance can be carried out using similar resistance adjustment materials. In order to further increase the elasticity of supplying roller 42, the roller is formed of a foamed, porous material using a greater amount of a foaming agent than that of the developing roller.

As an example, the porous foam material is a conductive urethane foam having a volume resistivity of about $10^5$ Ωcm, a cellular density of pores of 80 to 140 cells/inch and a hardness ranging from 60 degrees on Asker F basis to 30 degrees on Asker C basis. This urethane foam is mixed with carbon black in such a ratio that 5 to 15 parts by weight of carbon black is blended to 100 parts by weight of the foam. In some embodiments, about 70 parts by weight of carbon black may be blended. The polyurethane foam and carbon black are the same as used in developing roller 41.

In order to obtain a supplying roller 42 made up of the foam material having the above cellular density, polyurethane foam and carbon black, for example, are mixed and the mixture is stirred by a stirrer so as to be foamed, then the foam is coated around a stainless steel rotational shaft having a diameter of 8 mm by heat blow molding so that the roller has an outside diameter of 20 mm, thus forming a supplying roller 42.

The above supplying roller 42 has a bias voltage Vc applied thereto from bias voltage power circuit 12. This applied bias voltage is generally set at a value which urges the toner toward the developing roller 41 side or which causes supplying roller 42 to repel the toner therefrom and supply it to developing roller 41. For example, when a negatively charged toner is used, a bias voltage Vc greater to the negative side is applied to supplying roller 42.

Supplying roller 42 is pressed against developing roller 41 with a contact depth of about 0.5 mm to 1 mm and is rotationally driven in the direction of the arrow by an unillustrated driving motor with its peripheral speed set at 170 m/sec, for example. Further, supplying roller 42 has a voltage Vc (e.g., −400 V for a toner of negative characteristics) applied from toner supplying bias voltage circuit 12 via the rotational shaft.

Developing roller 41 and supplying roller 42 are coupled to an unillustrated driving motor as stated above so that they are rotationally driven in the directions of arrows (in the counterclockwise direction) in FIG. 4. Thus, supplying roller 42 supplies the toner to developing roller 41 and also scrapes (removes) the residual toner, which has not been used for development, from the surface of developing roller 41, after development. Before toner 10 supplied by supplying roller 42 and adhering to the developing roller 41 surface is conveyed to the developing area where the toner opposes the photoreceptor 1 surface, the amount of adherence of the toner is regulated by rotating regulating roller 43 so that the toner layer is constant in thickness. Here, the regulating element may be formed of a plate-like member as disclosed in Japanese Patent Application Laid-Open Hei 5 No. 113714.

Regulating roller 43 is pressed with an appropriate pressure against developing roller 41. This regulating roller 43 is rotated in the same direction as developing roller 41 so that the surface at the contact point with developing roller 41 moves in the direction opposite to that of the developing roller. The regulating roller 43 is a hard roller made-up of metal, hard resin material or the like, and is applied with a predetermined voltage Vb from a bias voltage power circuit 13 in order to set at the desired level the amount of charge on toner 10 which has been preliminarily charged by the aforementioned supplying roller 42. This bias voltage Vb is also designated so as to urge toner 10 toward the developing roller 41 side. For example, the voltage is set at a level having a greater value on the negative side if the toner is of negative polarity. Further, the regulating roller 43 has a regulating bias voltage Vb (e.g., −500 V) applied via the roller shaft thereof from toner layer thickness regulating bias voltage source 13.

Regulating roller 43 has a diameter of about 10 mm and is rotated in the same direction as developing roller 41 or counterclockwise in FIG. 4 with its surface speed set at 90 mm/sec. This roller regulates the thickness of the toner layer supported on developing roller 41 to about 10 to 15 μm, for example, and conveys it for development.

In the thus configured developing device 4, the toner 10 conveyed to the developing area where the toner opposes photoreceptor 1 selectively adheres to the static latent image formed on the photoreceptor 1 surface so as to develop the static latent image with the color of toner. Part of toner 10 which has not been used for development is returned into developer hopper 40 by the rotation of developing roller 41. An unillustrated sealing element is arranged in pressing contact with developing roller 41 at the position where the unused toner is collected. This sealing element is located after development or downstream of developing roller 41 with respect to its rotational direction and before its contact nip with supplying roller 42. One end of the sealing element is fixed to developer hopper 40 so that it abuts developing roller 41 with an appropriate pressure while the flat portion on the free end side abuts developing roller 41 by using its spring property.

Photoreceptor 1 used here may be an OPC photoreceptor which comprises a conductive substrate made up of metal or resin, an under layer coated on the surface of the substrate, a carrier generating layer (CGL) coated thereon and a carrier transfer layer (CTL) mainly composed of polycarbonate coated thereon as the topmost layer. This photoreceptor 1 is composed of a drum-shaped conductive substrate and a photoconductive layer of negative charge characteristics formed thereof and has a diameter of 65 mm, for example. This drum is rotationally driven in the direction of the arrow shown in FIG. 4 with its peripheral speed set at 190 mm/sec. Further, the surface of photoreceptor 1 is uniformly charged at about −550 V, for example, by charger 2 shown in FIG. 5. The photoreceptor in the present invention is not limited to this, and any photoreceptor can be used as long as it is a bearer that can support the static latent image.

The features of the present invention or the first embodiment of developing device 4 of the present invention will be hereinbelow described in detail with reference to the drawings.

(The First Embodiment of the Present Invention)

To begin with, developing roller 41 and supplying roller 42 are configured as stated above while regulating roller 43 is rotated as shown in FIG. 4 as it is being abutted against developing roller 41 with an appropriate pressure. With this arrangement, the toner is tribo-electrified and obtains static charge suitable for development and the amount of adherence of the toner to developing roller 41 is regulated at a constant.

Regulating roller 43 is composed of a metallic material or hard resin material, for example. Regulating roller 43 is rotated in the same direction as developing roller 41 or counterclockwise in FIG. 4 with its surface speed at 90 mm/sec, for example, whereby the thickness of the toner brought onto developing roller 41 by supplying roller 42 will be regulated to about 10 to 15 μm, for example. Similarly, a regulating bias voltage Vb (−450 V) for regulating the toner layer is applied to the roller shaft of regulating roller 43 from toner layer regulating bias voltage source 13.

Instead of the above-described regulating roller 43, a regulating blade of a plate configuration may be provided as the regulating element. This regulating blade can be configured of a metal plate of about 0.05 to 0.5 mm thick, for example and its one end is fixed to the developing hopper 40 side while its free end side is adapted to urge developing roller 41, making use of elastic deformation of the metal plate. The pressing or urging force is determined dependent upon the thickness of the toner layer formed on developing roller 41 and the amount of static charge on the toner and other factors.

Concerning the regulating blade, the distal end part abutting developing roller 41 is formed with a surface slightly inclined in the direction away from developing roller 41 so that it can stabilize the amount of adherence of the toner. The abutment surface of the regulating blade against developing roller 41 may be subjected to a coating treatment for control of the amount of static charge on the toner and protection against toner fusion.

The regulating blade may be formed of a metal plate having spring properties. Examples of the material include spring steel such as SUP etc., stainless steel such as SUS301, SUS304, SUS420J2, SUS631 etc., and copper alloys such as C1700, C1720, C5210, C7701 etc.

The inclination at the free end of the regulating blade may be simply formed by mechanical cutting, abrading, bending, or by applying a chip-like tip having a desired shape pre-formed by forming, using a conductive adhesive etc., or by shaping steps in the blade tip and applying metal foil thereon using a conductive adhesive etc.

Similarly, the regulating blade having the above configuration is also applied with a bias voltage Vb from power source circuit 13. The bias voltage is set at the same value as above.

In developing device 4 using a mono-component toner as above, the amount of adherence of toner 10 is regulated by regulating roller 43 put in pressing contact with developing roller 41 so that the layer thickness is constant. Then, toner 10 is conveyed to the developing area where it develops the static latent image on the photoreceptor 1 surface. During this, bias voltages Va, Vb and Vc are applied to developing roller 41, supplying roller 42 and blade 43, respectively to achieve beneficial development.

The above photoreceptor 1 is one composed of a drum-shaped conductive substrate and a photoconductive layer made up of a negative charge characteristic organic material coated on the substrate, has a diameter of 65 mm and is driven to rotate in the direction of the arrow in FIG. 1 at a peripheral speed of 190 mm/sec. This photoreceptor 1 is charged by charger 2 shown in FIG. 5, so that the surface potential thereof is uniformly set at about −550 V, for example.

(An example of Controlling the Developing Device of the Present Invention)

In developing device 4 of the present invention, the rotational drive control of developing roller 41, supplying roller 42 and regulating roller 43 and their bias voltage control are performed by the controller 50 shown in FIG. 1, which governs the total drive control of the whole image forming apparatus illustrated in FIG. 5. In the developing device shown in FIG. 4, this controller 50 performs control of the application of the individual bias voltages from voltage circuits 11 to 13 to the associated rollers, via control circuit 51. Further, in order to perform drive control of developing roller 41, supplying roller 42 and regulating roller 43, the associated drivers are controlled by way of a rotational drive control circuit 52 while control of image forming, including control of the process devices shown in FIG. 5, is performed.

For driving developing device 4 of the present invention during development, the predetermined bias voltages are applied by way of power source circuits 11, 12 and 13 in the same manner as illustrated already or as in the prior art to develop the static latent image formed on photoreceptor 1 with the toner. Therefore, controller 50, in response to a command of image forming, causes photoreceptor 1 to rotate, drives the charger etc., and causes photoreceptor 1 to be exposed to a light image to create a static latent image on photoreceptor 1.

Then, the static latent image is developed by developing device 4. For this purpose, controller 50 causes drive control circuit 52 to rotate developing roller 41. At the same time, supplying roller 42 and regulating roller 43 are rotationally driven in the directions of the arrows in FIG. 1. By this operation, the thickness of the toner layer on developing roller 41 is regulated to be constant and the regulated toner is conveyed to the developing area. Controller 50 drives supplying roller 42 and regulating roller 43 in the rotational directions shown in the drawing so as to regulate the thickness of the toner layer to be constant whilst controlling voltage control circuit 51 in order to supply the determined bias voltages from associated power source circuits 11 to 13.

The sequence of the image forming operation is thus effected and when all the actions relating to development are completed, controller 50 stops the developing operation of developing device 4. In this case, in the present invention, control in accordance with the control flowchart shown in FIG. 2 is performed conforming to the timing charts shown in FIGS. 3A and 3B. Explicitly, in the present invention, before the completion of the developing operation, the toner as the developer adhering on developing roller 41 is efficiently removed, the toner from its nip with supplying roller 42, for example, is cleared, thus preventing toner sticking.

Before explanation of the control before and after completion of the developing operation of the present invention, the conventional control example will be described with reference to FIG. 3B. When development is effected based on the image forming operation described above, and the developing operation has been completely finished, developing roller (developer support) 41 is stopped turning and toner supplying roller 42 is also stopped turning or (switched off) at the same time, as shown in FIG. 3B. At the same timing, regulating roller 43 is also stopped rotating, though not illustrated.

At the same timing developing roller 41 and supplying roller 42 are stopped, application of developing bias voltage Va and bias voltage Vc to supplying roller 42 is turned off.

Therefore, the toner remains left on developing roller 41 at its nip with supplying roller 42, being pressed until next operation. This may cause the toner to stick at that area. When the next developing operation is started, the stuck toner may disturb a uniform toner layer being formed by regulating roller 43, possibly causing development failures. This may also interfere with suitable charging of the toner, further making the development failures worse.

In contrast, in accordance with the present invention, before the development with developing device 4 is completed, the operation of developing device 4 is controlled by way of controller 50 shown in FIG. 1. This control is effected as shown in FIG. 2, following the timing chart shown in FIG. 3A.

Specifically, in the image forming apparatus, when the image forming operation is started, the developing action of developing device 4 starts (S1). When, with the formation of a static latent image completed on photoreceptor 1, the rear edge of the static latent image has passed through the developing area of developing device 4, the development essentially completes. Then, it is checked whether the time has reached the predetermined time t1 before the point of time T at which the entire developing operation will be completed (S2).

Here, the predetermined time t1 will be explained. As stated above, when the last static latent image on photoreceptor 1 has been developed by developing device 4, the development is complete. However, developing roller 41 etc., continue to rotate together with the rotation of photoreceptor 1, so that their operation has yet to complete. That is, photoreceptor 1 is kept on rotating after passing by the developing area so as to perform transfer of the toner image after development, be subjected to the cleaning treatment after transfer and then be removed of the remaining charge thereon. Thus, when the entire photoreceptor 1 surface is cleaned, the rotation is stopped. This is well known.

In time with this, the operation of developing device 4, particularly, the rotational drive of developing roller 41 is stopped, to completely finish the developing operation. For example, the rotation of developing roller 41 etc. of developing device 4 may be stopped in time with the stop control of the rotation of photoreceptor 1, or may be stopped some time after that to completely finish the developing operation.

The point of time T when the developing operation is completely finished can be known from the position of rotation of photoreceptor 1. And time from the point of time at which the rear edge of the static latent image formed on photoreceptor 1 passes by the developing area to the point of time at which the rear edge of the latent image on photoreceptor 1 passes by erasing device 7 is constant while the timing at which photoreceptor 1 will finally stop is determined. Therefore, controller 50 is capable of comprehending the point of time at which developing device 4 completely finishes the developing operation, in the course of control of image forming.

Therefore, at a point of time after the rear edge of the static latent image has been developed by developing roller 41 and the predetermined time t1 before the point of time T at which the developing operation is completely finished, controller 50 makes switching control of the bias voltage Vc applied to toner supplying roller 42, from −500 V to −250 V, for example (S3).

Actually, voltage control circuit 51, in response to the switching signal from controller 50, changes the bias voltage Vc applied to supplying roller 42, from −500 V to −250 V. After this switching control, developing roller 41 is kept on rotating (S4), though the essential development has been completed. Thereafter, it is checked whether the developing operation has been completely finished or whether time t1 has elapsed after the point of time when the switching control was made (S5).

When it is confirmed that the predetermined time t1 has passed, the developing operation is completed. That is, in time with the stop control of the rotation of photoreceptor 1, all the developing operation is determined to be completed so that the rotation of supplying roller 42 is stopped at the same time as the application of bias voltage Vc, the switched voltage, is turned off (S6). At the same time as this control, the rotation of developing roller 41 is stopped and the application of developing bias voltage Va is turned off.

Execution of the above-described control with developing device 4, makes it possible to prevent the toner remaining at the pressure nip between supplying roller 42 and developing roller 41 from sticking therein, even during the waiting mode. The mechanism of the prevention of the present invention will be described hereinbelow.

In developing device 4, during development or while the static latent image is developed, at least developing roller 41 and supplying roller 42 are being applied with the predetermined bias voltages whilst being rotated in the predetermined directions. For example, in the example described above, −350 V is applied to developing roller 41 and −500 V is applied to supplying roller 42.

Figure 6A:
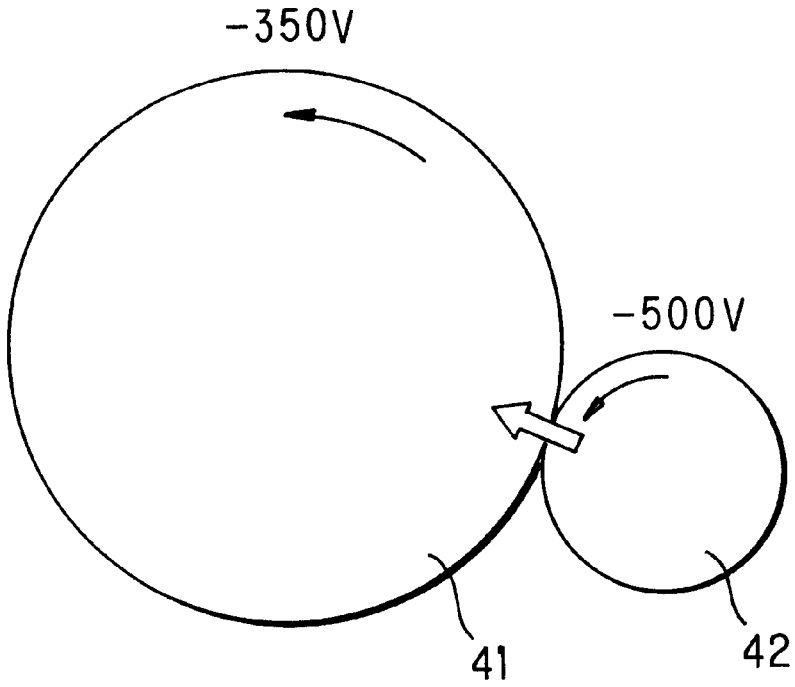
FIGS. 6A and 6B are diagrams for illustrating the direction of movement of the toner dependent upon the direction of the electric field in the first embodiment of the present invention.

With this relationship between the bias voltages during development, the negative charged toner is urged toward the developing roller 41 side, as indicated by the arrow in FIG. 6A. The toner supplied by supplying roller 42 will not be attracted to the supplying roller 42 side but is fed to the developing roller 41 side. Actually, supplying roller 42 scrapes the collected toner after development off the developing roller on its upstream side by the force derived from the relative movement of the rollers and supplies the fresh toner to the developing roller on its downstream side. Under this operating state, the toner can be well scraped and supplied, so that no toner sticking will occur even if some toner is held between the two rollers 41 and 42.

Figure 6B:
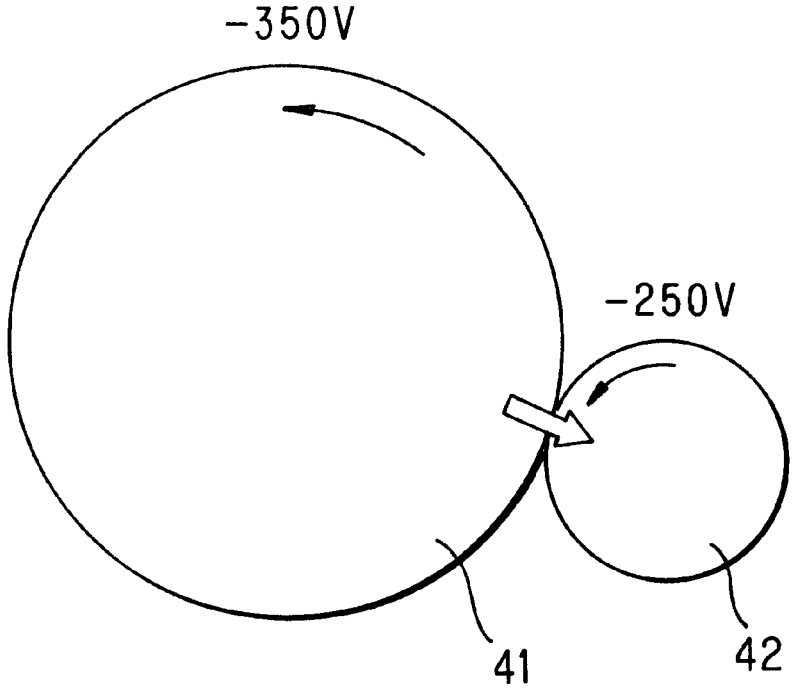

After development of the static latent image has been finished, at a point of time, the predetermined time t1 before the timing at which the developing operation of developing device 4 is completely finished, bias voltage Vc applied to supplying roller 42 is level-shifted. After this switching, bias voltage Vc is set at −250 V while developing bias voltage Va of developing roller 41 remains at −350 V, so that the relation of the potential difference becomes reversed compared to that during development. This situation is shown in FIG. 6B.

In this way, since the relationship of the potential difference becomes totally opposite to that during development, this electric field causes the toner adhering to developing roller 41 to be attracted to the supplying roller 42 side. That is, the electric field during development exerts force on the toner in such a direction that the toner transfers from the supplying roller 42 side to developing roller 41, but the direction of the electric field is reversed. Further, since developing roller 41 and supplying roller 42 are kept rotating in the directions shown in the drawing, the toner adhering to developing roller.41 is effectively scraped off (removed) whilst being attracted to the supplying roller 42 side. This action continues until the developing operation is totally completed and developing roller 41 is stopped.

Accordingly, up to the lapse of the predetermined time t1, the toner adhering to the developing roller 41 surface is efficiently scraped off with the effect of the electric field, so that after developing roller 41 etc. are stopped, there exists no toner between developing roller 41 and supplying roller 42, whereby it is possible to prevent toner sticking.

In the above operation, concerning regulating roller 43, bias voltage Vb to regulating roller 43 may be level-shifted in time with the switching of bias voltage Vc to supplying roller 42. For example, when the bias voltage to regulating roller 43 is shifted to about −250 V, the toner will not be attracted to the developing roller side and is attracted to the regulating roller side, whereby it is possible similarly to eliminate the problem of toner sticking and the like.

In this case, since developing roller 41 is continuously driven in the same rotational direction without being reversed, no damage to photoreceptor 1 due to reverse rotation will occur even if development is performed with the developing roller in contact with photoreceptor 1. Therefore, this method can be applied to a developing system in which the developing roller is put in pressing contact with photoreceptor 1. Needless to say, this method can also be applied as is to a non-contact developing system in which developing roller 41 is kept away from photoreceptor 1.

The predetermined time t1 for the time taken before reaching the time T when the developing operation is totally completed should be determined so as to allow developing roller 41 to rotate at least one revolution, from the contact point with supplying roller 42. This means that one revolution of the developing roller permits the toner after development on the entire periphery to be scraped off by supplying roller 42 and hence can, at least, exclude the toner between supplying roller 42 and developing roller 41. Most preferably, the predetermined time t1 should be determined so as to allow developing roller 41 to make five or six revolutions. This setting could almost perfectly prevent deficiencies of toner sticking.

In the above, the predetermined time t1 is determined based on the complete point of time T at which developing roller 41 is stopped in time with the rotation stop of photoreceptor 1. However, the predetermined time t1 may be determined based on the point of time at which the ending area (e.g., the rear edge) of the static latent image which should be developed by developing roller 41 passes through the developing area. In this case, the time up to when developing roller 41 stops rotating may and should be taken as the predetermined time t1. Thus, when the predetermined time t1 is set as that from the end of development of the rear end of the latent image to the end of the developing operation at which developing roller 41 is stopped, developing roller 41 can be rotated much more than one full revolution or the time may allow the developing roller to rotate five or six revolutions or more. It should be noted that if the bias voltage to supplying roller 42 is level-shifted at the time that development of the end area of the static latent image has been completed, this will not cause any influence on development.

With the above setting, since time taken for the exposure end to move from the exposure position 3 where photoreceptor is exposed to a light image, to its arrival at the developing area is fixed, the switching control of the bias voltage to supplying roller 42 after a lapse of the fixed time from the point of time of the end of exposure, or at a point of time after the exposure end passes by the developing area (S4) can be carried out by means of control circuit 51 in controller 50. The time from the above switching timing to the point of time T at which the developing operation is completely finished is referred to as the predetermined time t1.

Upon the switching control of bias voltage Vc to supplying roller 42, the absolute value of the potential difference between the two rollers during development is 150 V whereas the absolute value of the potential difference after the switching control is 100 V. If this potential difference exceeds 400 V, though dependent upon the impedance etc., there is a risk that discharge might start. Once such a discharge occurs, the toner may become fused due to its heat and might stick. In the above example of the present invention, without any risk of discharge starting, the toner adhering to the developing roller 41 side can be scraped off by supplying roller 42 and the problem of sticking due to discharge can be eliminated altogether. Thus, setting of the potential difference between developing roller 41 and supplying roller 42 at a value lower than the discharge starting voltage provides the above effect.

As has been described heretofore, in developing device 4 of the present invention, bias voltage Vc applied to supplying roller 42 is level-shifted at a point of time the predetermined time t1 before the point of time T at which the development is completely finished, in order to control its potential difference relative to developing roller 41 so that an electric field that exerts force opposite to that during development will be created. By this control, until the point of time T at which the developing operation is completely finished, the rotation of supplying roller 42 and developing roller 41 is kept the same as that during development, so as to inhibit adherence of the toner to developing roller 41 and enhance the scraping effect, whereby it is possible to prevent the toner from remaining between developing roller 41 and supplying roller 42 and hence prevent toner sticking in an effective manner.

In accordance with the above example, since the potential differences between developing roller 41 and supplying roller 42 during development and after development are set to be lower than the discharge starting voltage, it is also possible to eliminate the risk of the toner etc. adhering to developing roller 41 due to heat from electric discharge.

According to the embodiment of the present invention, the description has been made using negatively charged toner as an example of the toner, but if positively charged toner is used, bias voltages to developing roller 41, supplying roller 42 etc., should be set to be positive. Also in this case, similarly to that shown in FIGS. 6A and 6B, the potential difference between the two rollers during development should be set so as to create an electric field that will facilitate the toner to transfer to the developing roller 41 side while the potential difference after development should be set so as to create an electric field that will cause the toner to be attracted to the supplying roller 42 side. These potential differences should be set to be lower than the discharge starting voltage.

In the description of the timing chart shown in FIG. 3A as well as the description heretofore, it was described that the bias voltage to supplying roller 42 after the level shift control at the timing of the predetermined time t1 before the point of time at which the developing operation is completely finished, should be set exclusively to −250 V. But the present invention should not be limited to this. That is, the levels of bias voltage Vc etc., can be set so that the forces exerted by the electric fields during development and after development will become reversed as shown in FIGS. 6A and 6B. Also in this case, the potential difference to developing roller 41 may and should be set to be lower than the discharge starting voltage. Further, it is also possible to switch the level of developing bias Va to developing roller 41 or switch the levels of both.

However, if developing bias voltage Va is level-shifted, there is a fear that toner adherence to photoreceptor 1 and other problems might occur. Actually, the developing bias voltage is set based on the relationship between the potential of the latent image formed on the photoreceptor and that of the background having no latent image (non-image area in the background), and particularly is set at an optimal value which disallows the toner to adhere to the background and allows the toner to be attracted to the latent image areas. Therefore, if bias voltage Va is shifted, the toner might unnecessarily adhere to the non-image area. Even if no unnecessary toner adherence occurs switching of bias voltage Vc to supplying roller 42 and developing bias voltage Va at the same time results in the necessity of a complicated circuit configuration.

As a result, the level shift control of bias voltage Vc is to supplying roller 42 only, as described in the embodiment of the present invention which makes the configuration simple and makes it possible to prevent the toner from adhering to the non-image area on the photoreceptor, so it can be said to be a very effective means and configuration.

(A Variational Mode of the First Embodiment of the Present Invention)

In accordance with the first embodiment of the present invention described heretofore, bias voltage Vc to supplying roller 42 is level-shifted first and then is turned off at the same time developing bias voltage Va to developing roller 41 is turned off when the developing operation is completely finished.

In accordance with the variational embodiment of the present invention described hereinbelow, the effects obtained from the first embodiment can be further enhanced and toner sticking can be prevented more positively. This control method will be described next.

Figure 7:
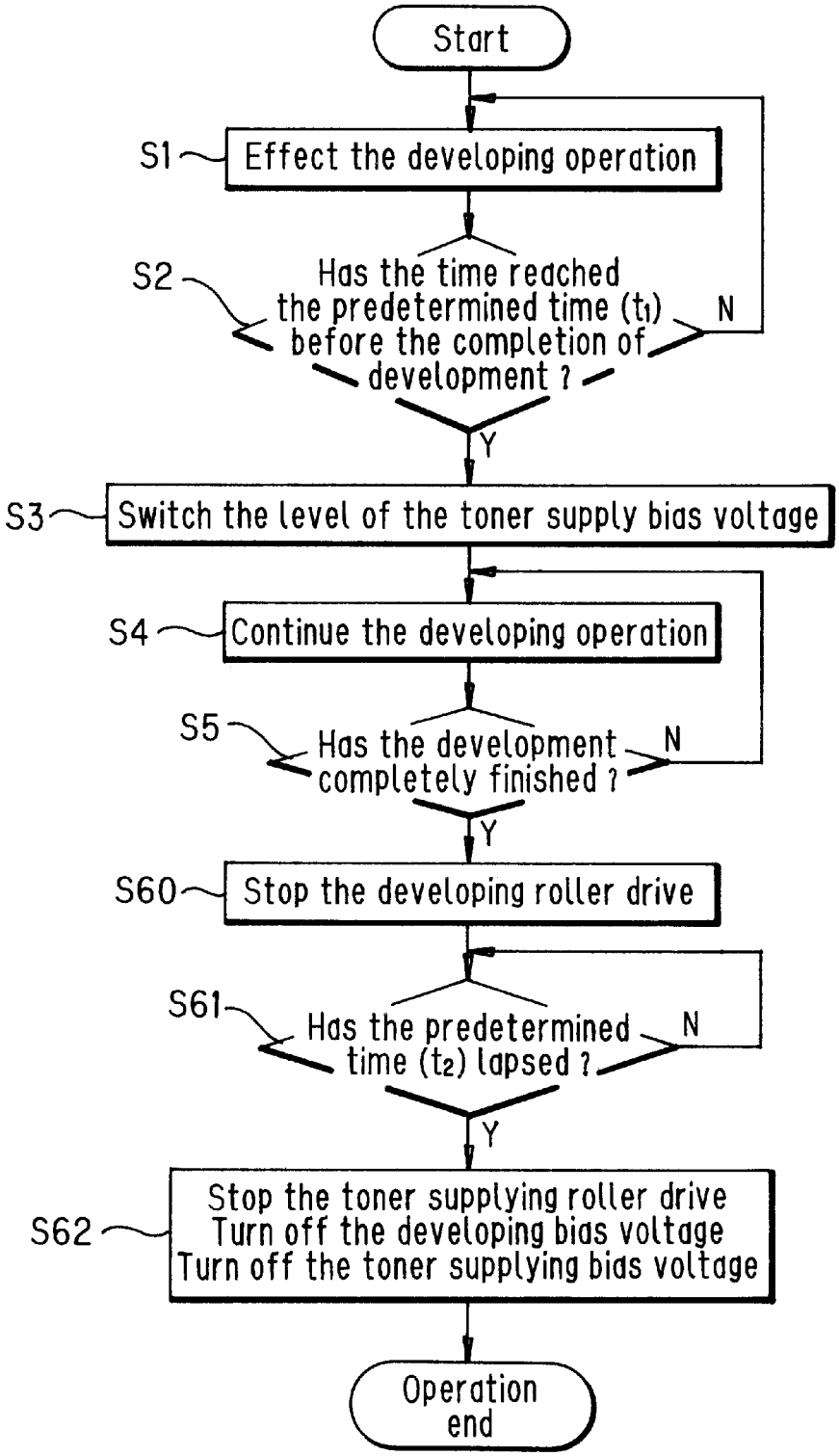
FIG. 7 is a control flowchart for illustrating the control sequence of a developing device of a variational mode of the first embodiment of the present invention.
Figure 8:
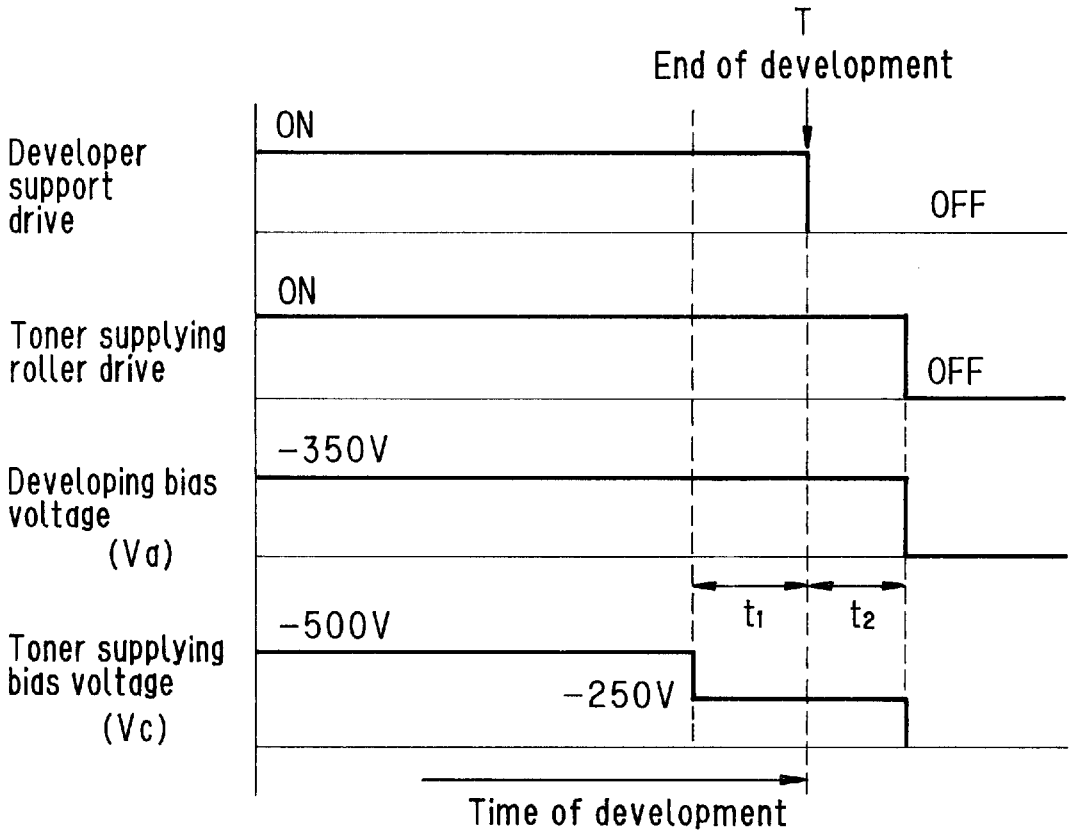
FIG. 8 is a timing chart showing the control timing in association with the control sequence in the control flowchart shown in FIG. 7.

Referring next to FIGS. 7 and 8, the variational embodiment will be described. Particularly, in the timing chart shown in FIG. 8, if described in terms of the timing chart shown in FIG. 3A, supplying roller 42 continues to be rotated a predetermined time t2 further longer from the point of time T at which the developing operation is completely finished while the application of bias voltage Vc to supplying roller 42 is also continued. As to developing roller 41, it is stopped at the point of time T while the application of developing bias voltage Va to developing roller 41 is continued as is.

Since bias voltages Va and Vc are continuously kept at the same levels, the toner will not be supplied to developing roller 41. Since only supplying roller 42 is rotated, this functions so that the toner on supplying roller 42 is scraped off by developing roller 41 which is stationary. Therefore, for the predetermined period of time t2 from the point of time T at which the developing operation is completed, the toner adhering to supplying roller 42 is removed efficiently. Resultantly, the toner residing between developing roller 41 and supplying roller 42 can be forced out to enhance the prevention effect against toner sticking. This configuration also prevents toner sticking to supplying roller 42 and hence leads to a long life of supplying roller 42.

As shown in FIG. 7, the control sequence of this operation up to Step S5 is the same as shown in FIG. 2, and the control thereafter by controller 50 differs from that. At Step S60, the rotation of developing roller 41 is stopped. This can be done in synchronism with the rotation stop of photoreceptor 1, after confirmation of the point of time T at which the developing operation is completely finished.

Then, it is checked whether the predetermined time t2 has elapsed from the point of time T (S61). If the judgement is affirmative, the drive of supplying roller 42 is stopped, application of developing bias voltage Va to developing roller 41 is stopped and application of bias voltage Vc to supplying roller 42 is stopped (S62) to complete the operation.

By this operation, removal of the toner adhering to supplying roller 42 can be carried out effectively, thus enhancing the prevention effect against toner sticking to developing roller 41 and inhibiting toner sticking to supplying roller 42. As a result, the prevention effect against toner sticking is further promoted, whereby it is possible to keep the developing operation stable without degrading the image quality, for a long time.

As shown in the timing chart in FIG. 8, the rotation of developing roller 41 is stopped at the point of time T at which the developing operation is completely finished. In this way, since the developing roller is stopped in time with the rotation stop of photoreceptor 1, it is also possible to prevent developing roller 41 from rubbing and damaging or markedly abrading the photoreceptor 1 surface.

Also in the above variational embodiment of the present invention, the description has been made of the case where developing roller 41 is abutted on photoreceptor 1. However, the invention should not be limited to the device of this type but the present invention can be applied to a non-contact type developing device in which developing roller 41 is arranged a certain distance away from photoreceptor 1.

In a case where non-contact type development is effected with developing roller 41 spaced from photoreceptor 1, the rotational stop control of developing roller 41 need not be made in synchronism with the stop control of the photoreceptor. That is, developing roller 41 may and should be stopped the predetermined time t1 (the time longer than that for the developing roller to make one or more revolutions) after development of the end area (the rear end) of the static latent image has been completed. Then, supplying roller 42 continues to be rotated the predetermined time t2 from then on and may and should be stopped after a lapse of the predetermined time t1. In this case, the stop control after a lapse of constant time t1 may coincide with the stop control of photoreceptor 1 or may be finished before it.

Next, the features of the present invention or the featured configuration of developing device 4 of the present invention will be described and the second embodiment, the optimal mode to attain the object of the present invention, will be described in detail with reference to the structural view of FIG. 13 and FIGS. 9 to 12.

(The Second Embodiment of the Invention)

Figure 13:
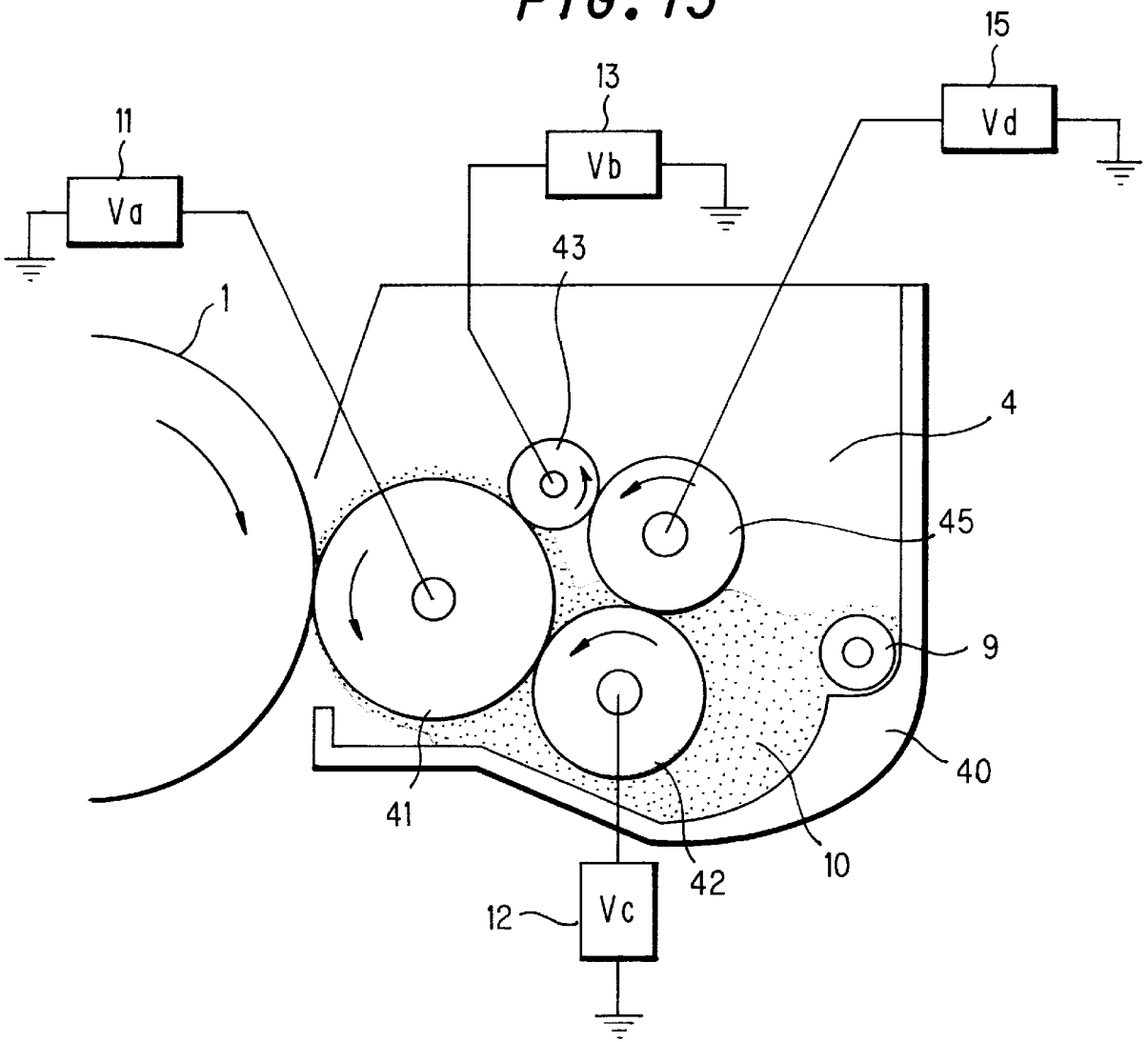
FIG. 13 is a view showing the internal configuration of a mono component toner developing device in accordance with the second embodiment of the present invention.

In developing device 4 of this embodiment, other than developing roller 41, supplying roller 42 for supplying toner 10 to developing roller 41 and regulating roller 43 for limiting the toner layer to the fixed amount, an extra roller, namely cleaning roller 45, being in contact with supplying roller 42 and regulating roller 43 and scraping the toner therefrom is provided, as shown in FIG. 13.

Cleaning roller 45, as shown in FIG. 13, is arranged at the position opposite to that of developing roller 41 being in pressing contact with supplying roller 42 and regulating roller 43, so that it comes in pressing contact with supplying roller 42 and regulating roller 43.

Cleaning roller 45 is also rotated in the counterclockwise direction in FIG. 13, as supplying roller 42 and regulating roller 43 do. This cleaning roller 45 can be a hard roller made up of metal or hard resin material or the like.

Alternatively, it is preferable to construct cleaning roller 45 with the same resilient material as supplying roller 42, i.e., a foamed material such as of urethane rubber etc. Cleaning roller 45 is composed of a metal shaft and the foamed urethane rubber coated thereon with its diameter about 20 mm. The cleaning roller is driven at a peripheral speed of 140 mm/sec whilst it is being in contact with supplying roller 42 and regulating roller 43.

A bias voltage is applied also to cleaning roller 45. Specifically, a bias voltage Vd of about −450 V, for example, is applied from a bias voltage power circuit 15 to the rotational shaft of cleaning roller 45 when a negative toner is used.

Figure 9:
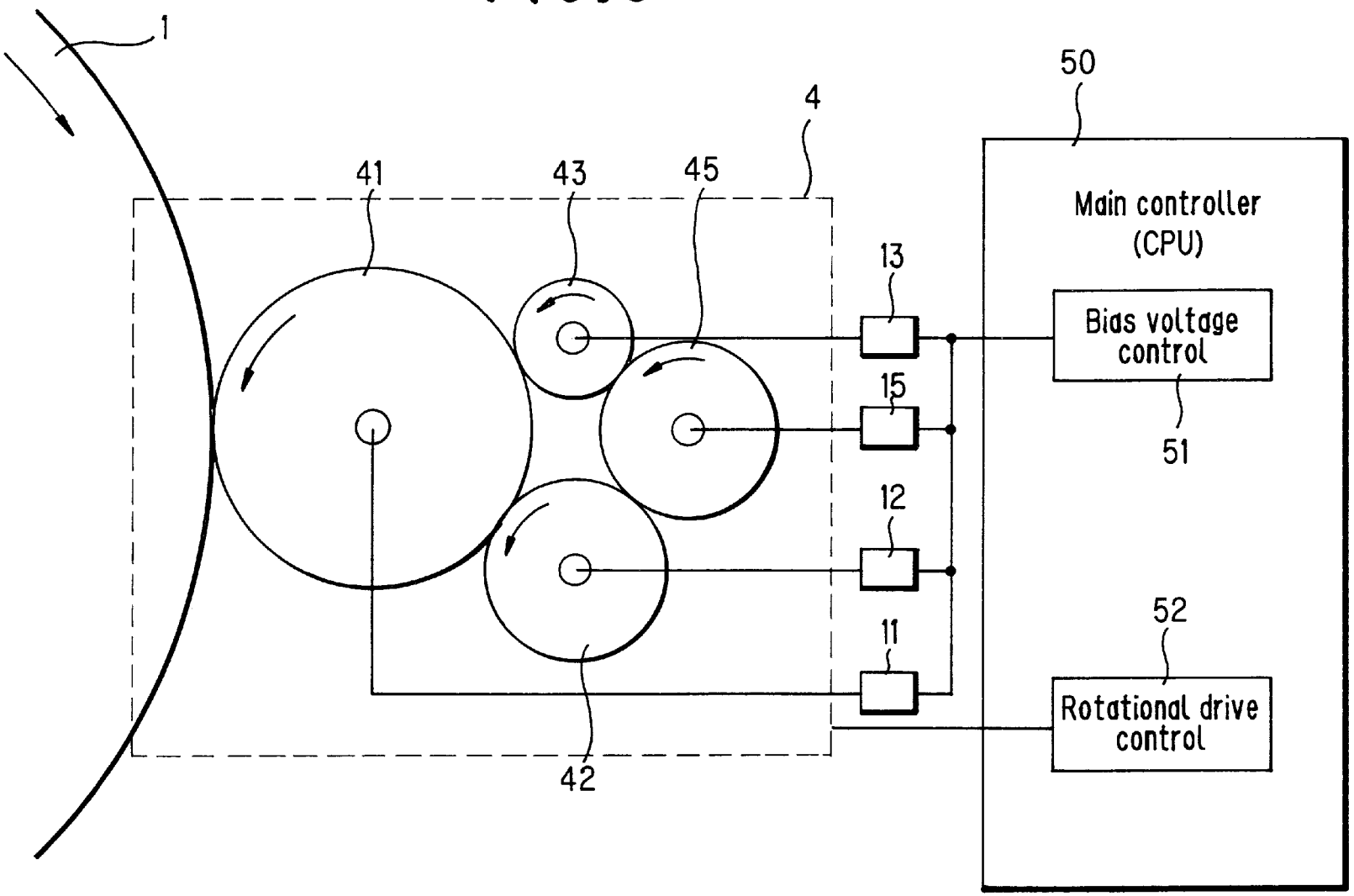
FIG. 9 is a diagram showing a control circuit configuration for illustrating an example of controlling a mono component toner developing device of the second embodiment of the present invention.

In developing device 4 of the present invention, the rotational drive control of developing roller 41, supplying, roller 42, regulating roller 43 and cleaning roller 45 and their bias voltage control are performed by the controller 50 shown in FIG. 9, which governs the total drive control of the whole image forming apparatus illustrated in FIG. 5. In the developing device shown in FIGS. 12A, 12B and 12C, this controller 50 performs control of the application of the individual bias voltages from voltage circuits 11, 12, 13 and 15 to the associated rollers, via power control circuit (bias voltage control circuit) 51. Further, in order to perform drive control of developing roller 41, supplying roller 42, regulating roller 43 and cleaning roller 45, the associated drivers are controlled by way of a rotational drive control circuit 52 while control of image forming, including control of the process devices shown in FIG. 5, is performed.

For driving developing device 4 of the present invention during development, the predetermined bias voltages are applied by way of, at least, power source circuits 11, 12 and 13 in the same manner as illustrated already or as in the prior art to develop the static latent image formed on photoreceptor 1 with the toner. Therefore, controller 50, in response to a command of image forming, causes photoreceptor 1 to rotate, drives the charger etc., and causes photoreceptor 1 to be exposed to a light image to create a static latent image on photoreceptor 1.

Then, the static latent image is developed by developing device 4. For this purpose, controller 50 causes drive control circuit 52 to rotate developing roller 41. At the same time, supplying roller 42 and regulating roller 43 are rotationally driven in the directions of the arrows in FIG. 9. By this operation, the thickness of the toner layer on developing roller 41 is regulated to be constant and the regulated toner is conveyed to the developing area. Controller 50 drives supplying roller 42 and regulating roller 43 in the rotational directions shown in the drawing so as to regulate the thickness of the toner layer to be constant whilst controlling voltage control circuit 51 in order to supply the determined bias voltages from associated power source circuits 11 to 13.

Figure 12A:
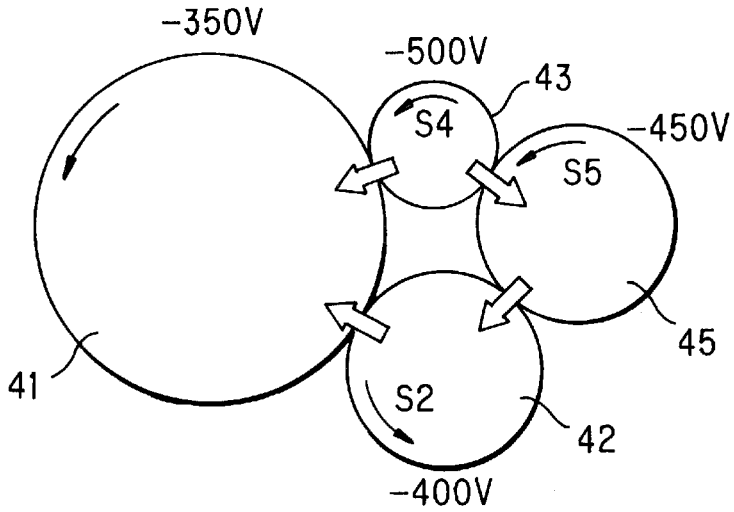
FIGS. 12A to 12C are illustrative diagrams for explaining the toner removing process of the second embodiment of the present invention.
Figure 12B:
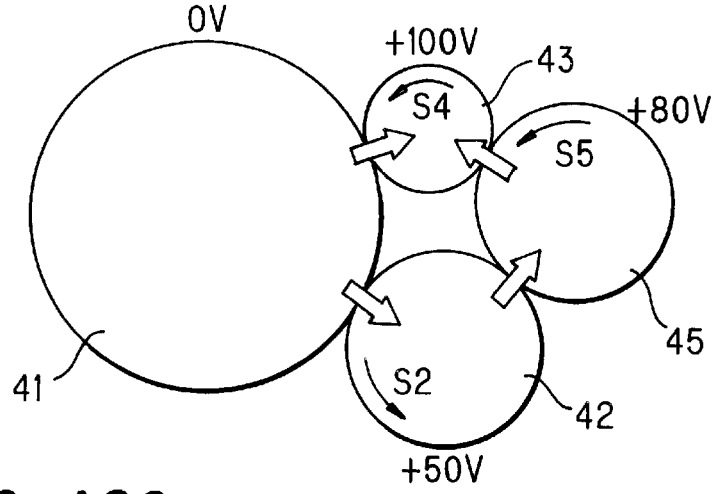
Figure 12C:
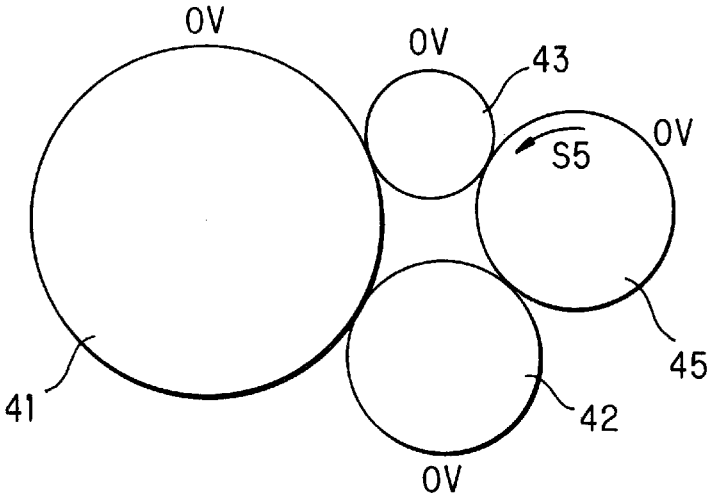

The sequence of the image forming operation is thus effected. In this operation, in the developing device 4 of the present invention, cleaning roller 45 is rotated and driven together with the rotation of developing roller 41, as shown in FIGS. 12A, 12B and 12C. Since cleaning roller 45 is applied with a bias voltage which will cause the toner to move from the regulating roller 43 side to cleaning roller 45, the toner adhering to regulating roller 43 is effectively removed so that the regulating roller which has been cleaned abuts developing roller 41 hence regulates the toner layer in a more stable way.

Further, since the bias voltage applied to cleaning roller 45 causes the toner to move to supplying roller 42, the toner can be efficiently supplied to supplying roller 42. As a result, supplying roller 42 can efficiently feed the toner to developing roller 41.

Thus, provision of cleaning roller 45 further enhances the aforementioned effect of toner supply and uniformity of the toner layer, realizing stabilized development. Here, cleaning roller 45 is provided to remove the toner from the regulating roller 43 surface and to supply the toner to supplying roller 42 in an efficient manner. Therefore, the pressing force acting on each roller may differ from that on the other. The pressing force acting on regulating roller 43 is set to be greater than that on supplying roller 42.

Developing device 4 of this embodiment is thus configured. Now, the control operation after development of the present invention will be explained. First, the image forming operation is first effected, and when the operation is ended or when the developing operation is completely finished, controller 50 performs control of stopping the developing operation of developing device 4. In this case, the control operation of this embodiment of the present invention is effected in accordance with the control flow chart shown in FIG. 10 and the timing charts shown in FIGS. 11A and 11B.

Illustratively, in the present invention, after development of the end area of the static latent image, the toner as the developer adhering on developing roller 41 is efficiently removed, the toner from its nips with regulating roller 43 and supplying roller 42, for example, is cleared, thus preventing toner sticking.

Before explanation of the control before and after completion of the developing operation of the present invention; the conventional control example will be described briefly.

When development is effected based on the image forming operation and the developing operation has been completely finished, developing roller (developer support) 41 is stopped turning and toner supplying roller 42 and regulating roller 43 are also stopped turning (or switched off) at the same time.

At the same timing developing roller 41 and supplying roller 42 are stopped, application of developing bias voltage Va, bias voltage Vc to supplying roller 42 and bias voltage Vb to regulating roller 43 is turned off by way of power control circuit 52.

Therefore, the toner remains left on developing roller 41 at its nips with supplying roller 42 and regulating roller 43, being pressed until next operation. This may cause the toner to stick at that area. When the next developing operation is started, the stuck toner may disturb a uniform toner layer being formed by regulating roller 43, possibly causing development failures. This may also interfere with suitable charging of the toner, further making the development failures worse.

Figure 10:
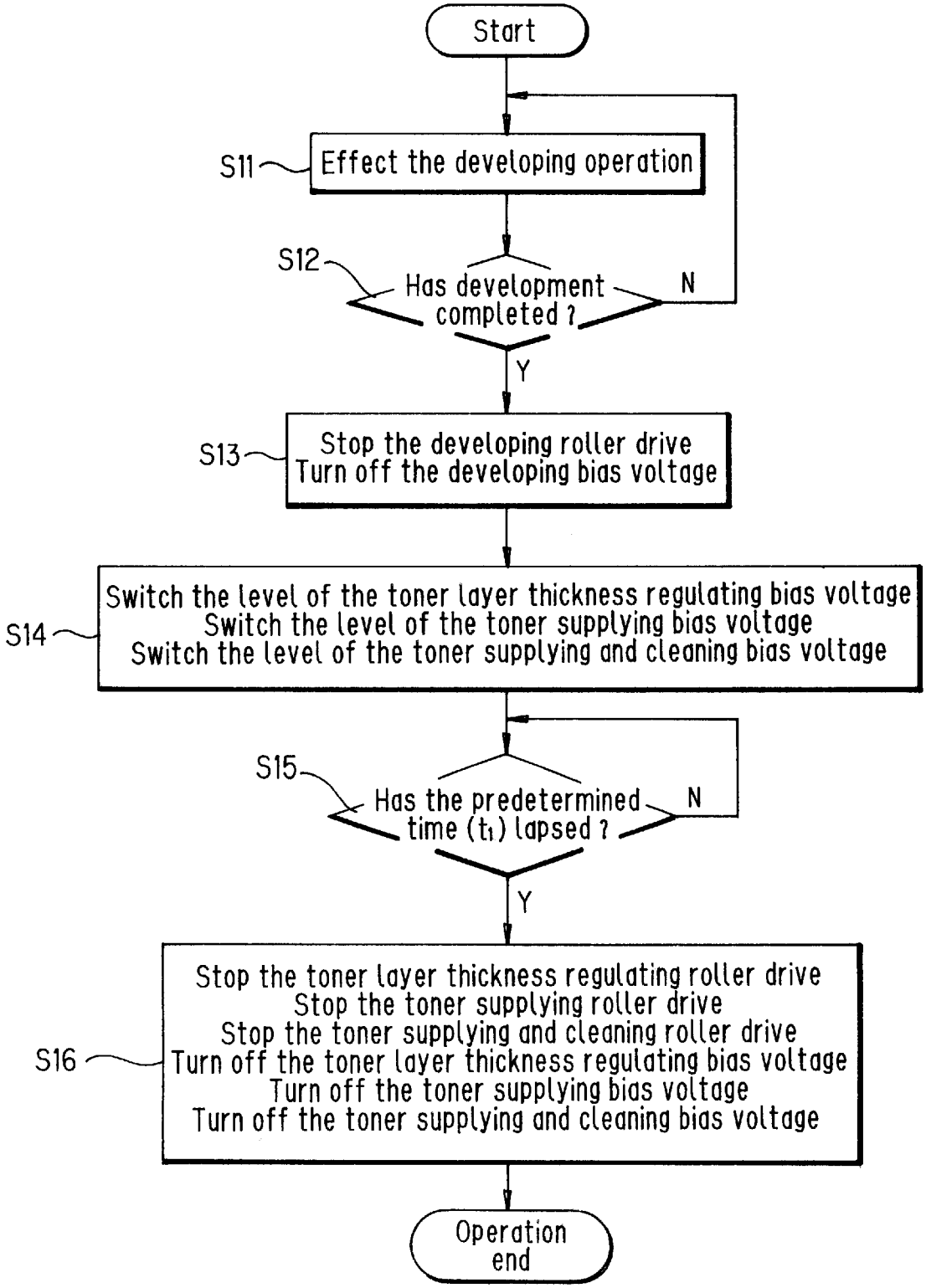
FIG. 10 is a control flowchart showing the control sequence of the control circuit configuration shown in FIG. 9, in particular, showing the control sequence of the developing device after the completion of development.

In contrast, in accordance with the present invention, when the development with developing device 4 is effected and completed, in response to this the control operation of the developing device is effected by way of controller 50 shown in FIG. 9. The sequence of this operation is effected as shown in FIG. 10, following the timing chart shown in FIG. 11A.

Specifically, in the image forming apparatus of the present invention, when the image forming operation is started, the developing action of developing device 4 starts (S11). When, with development of the static latent image formed on photoreceptor 1 completed, photoreceptor 1 has passed through the transfer station, the cleaning station and the position for erasing the residual charge on photoreceptor 1. Thus, when the entire photoreceptor 1 surface is cleaned, the rotation is stopped. In time with this, the rotation of developing roller 41 is stopped, to complete the developing operation.

When it is confirmed that the aforementioned developing operation has been completed (S12), rotation of developing roller 41 is stopped in time with the rotation stop of photoreceptor 1 (S13). Controller 50, as it stops the rotation of developing roller 41, turns off the application of developing bias voltage Va (S13). At the same time, controller 50 switches the levels of the bias voltages to supplying roller 42, regulating roller 43 and cleaning roller 45 (S14). This level shifting of each voltage is done as shown in FIGS. 12A, 12B and 12C or FIG. 11A, for example.

The above controller 50, whilst performing the above control, keeps rotating supplying roller 42, regulating roller 43 and cleaning roller 45 for a fixed period (t1).

While switching control of the bias voltages and continuous driving of the rollers for a fixed period, there arise electric fields that will cause the toner to move from the developing roller 41 side to supplying roller 42 and to regulating roller 43, as shown in FIG. 12B. Therefore, the toner adhering to developing roller 41 is effectively removed as supplying roller 42 and regulating roller 43 rotate.

The above mechanism of prevention against toner sticking will be further detailed. As shown in FIG. 12A, during the developing operation, bias voltages Vb and Vc applied to regulating roller 43 and supplying roller 42 with respect to developing bias voltage Va produce electric fields (or have potential relationships) which will drive the toner toward developing roller 41. When development is completed, the levels of the bias voltages to supplying roller 42 and regulating roller 43 are shifted, electric fields which will drive the toner from the developing roller 41 side toward supplying roller 42 and regulating roller 43 sides arise.

In this way, switching the bias voltages from the period of development to the predetermined period (t1) after development, reverses the direction of the electric fields that drive the toner, so that the attractive and repulsive forces before switching are weakened and hence the stickiness of the toner to the roller surfaces is reduced. As a result, the toner can be efficiently removed by supplying roller 42 and regulating roller 43 which are kept rotating.

Further, the same situation occurs in the contact points between cleaning roller 45 and supplying roller 42. and between cleaning roller 45 and regulating roller 43. Therefore, the toner stickiness at the contact points is weakened so that removal function of the toner by rotating cleaning roller 45 can be enhanced.

As described heretofore, controller 50 causes drive control circuit 52 to stop the drive of developing roller 41 while keeping up the rotation of supplying roller 42, regulating roller 43 and cleaning roller 45. In addition to this, voltage source control circuit 51 turns off the application of developing bias voltage Va to developing roller 41 and controls the levels of bias voltages Vc, Vb and Vd to supplying roller 42, regulating roller 43 and cleaning roller 45, so that the electric fields exerting on the toner are reversed from that before switching and keeps them at the levels for the predetermined time t1.

Then, it is checked whether the predetermined time t1 has lapsed (S15). If the judgement is affirmative, supplying roller 42, regulating roller 43 and cleaning roller 45 are stopped turning (OFF) while the level-shifted bias voltages are also turned off (set at 0 V), as shown in the timing chart in FIG. 11A. (S16). This sets the developing device for the next image forming operation.

Execution of the control of developing device 4 described heretofore efficiently removes the residual toner remaining, inclusive of the waiting period, at contact points (the nip areas) between developing roller 41 and supplying roller 42 and between developing roller 41 and regulating roller 43, thus making it possible to eliminate the factor of toner sticking and realize prevention against toner sticking.

When the developing operation is completed, developing roller 41 is controlled so as to be stopped while supplying roller 42, regulating roller 43 and cleaning roller 45 are kept on rotating for the predetermined period of time. It is preferred that this predetermined time t1 should be set so as to allow supplying roller 42, regulating roller 43 and cleaning roller 45 to rotate at least one revolution, from their positions at the end of development. This means that more than one revolution permits the toner on the entire periphery of each roller to be removed off when the stickiness is weakened by rotation of supplying roller 42, regulating roller 43 and cleaning roller 45. Therefore, when the supplying roller, regulating roller 43 etc., are stopped, the toner residing between the rollers can be removed, thus making it possible to eliminate the factor of toner sticking during the inoperative state.

Most preferably, the predetermined time t1 should be determined so as to allow supplying roller 42, regulating roller 43 and cleaning roller 45 to make five or six revolutions. This setting could almost perfectly prevent deficiencies of toner sticking. In this case, since the rotational rate of supplying roller 42 is highest, if the time required for supplying roller 42 to make five revolutions, for example, is set as the predetermined time t1, the number of revolutions made by cleaning roller 45 is lower than five. Therefore, it is preferred that, based on the relationship between roller's diameters and their peripheral speeds, the longest time taken for making five revolutions among these rollers should be set as the predetermined time t1.

In the description of the control scheme in the above embodiment of the present invention, though a negatively charged toner is used as an example, the bias voltages to developing roller 41, supplying roller 42, regulating roller 43 and cleaning roller 45 etc., may and should be set to be positive if a positively charged toner is used.

Figure 11A:
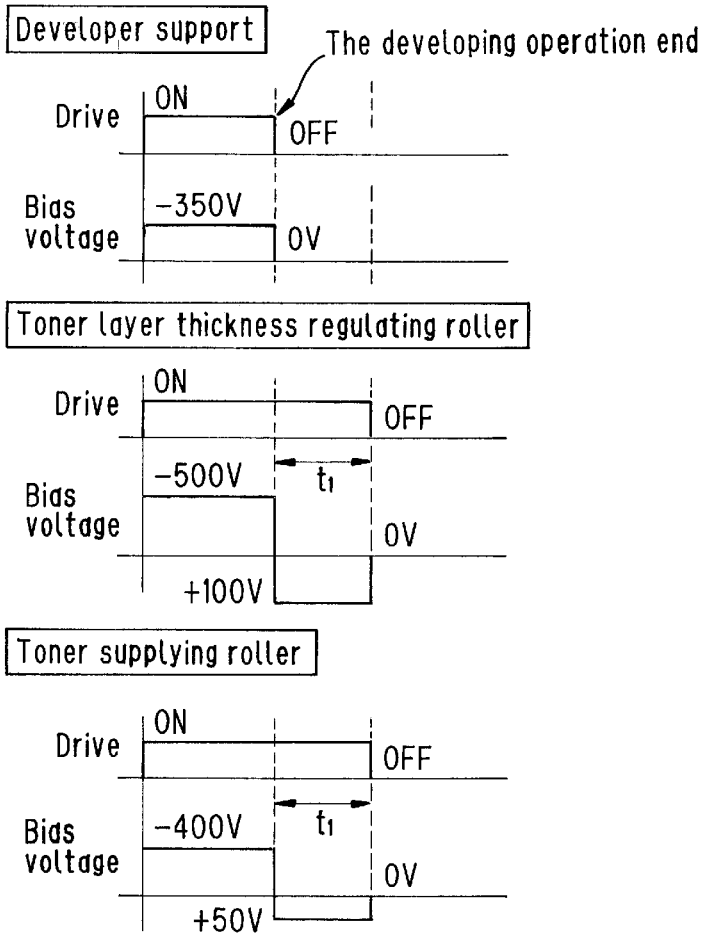
FIGS. 11A and 11B are timing charts showing the control timing in association with the control flowchart shown in FIG. 9, FIG. 11A showing a case in one mode of the second embodiment of the present invention and FIG. 11B showing a case in a variational mode.

In the description of the timing chart shown in FIG. 11A and the above explanation, for the predetermined time t1 from the end point of time of the developing operation, the bias voltages applied to supplying roller 42, regulating roller 43 and cleaning roller 45 are controlled so as to be level shifted. During this period, the bias voltage Va applied to developing roller 41 is set at 0 V. Therefore, the potential differences at all the contact points between the rollers are set to be lower than the discharge starting voltage. This setting prevents the toner from being fused from heat originated from discharge and hence eliminates the occurrence of toner sticking. In particular, if the potential difference between rollers is set at most 400 V or lower, it is possible to inhibit occurrence of discharge phenomena. The potential difference lower than 300 V is good enough to avoid occurrence of discharge, even taking into account the environmental variations, etc.

(A Variational Mode of the Second Embodiment of the Present Invention)

In accordance with the second embodiment of the present invention described heretofore, in response to the end of the developing operation, rotation of developing roller 41 is stopped and application of the developing bias voltage is turned off while supplying roller 42, regulating roller 43 and cleaning roller 45 are kept on rotating for the predetermined time t1 with their bias voltages level shifted and turned off after a lapse of the time t1. Thus, this configuration eliminates the problem of toner sticking.

In the present invention, cleaning roller 45 is added extra so as to provide the function of cleaning regulating roller 43 and the function of supplying the toner to supplying roller 42. Now, the method and configuration of alleviating and preventing the problem of toner sticking between cleaning roller 45 and supplying roller 42 and between cleaning roller 45 and regulating roller 43, by utilizing rotation of cleaning roller, will be described.

Figure 11B:
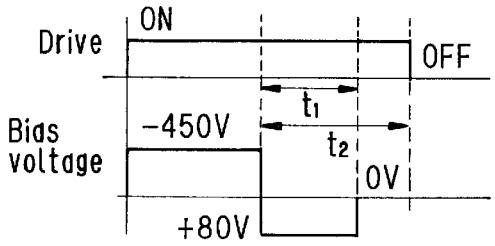
Figure 14:
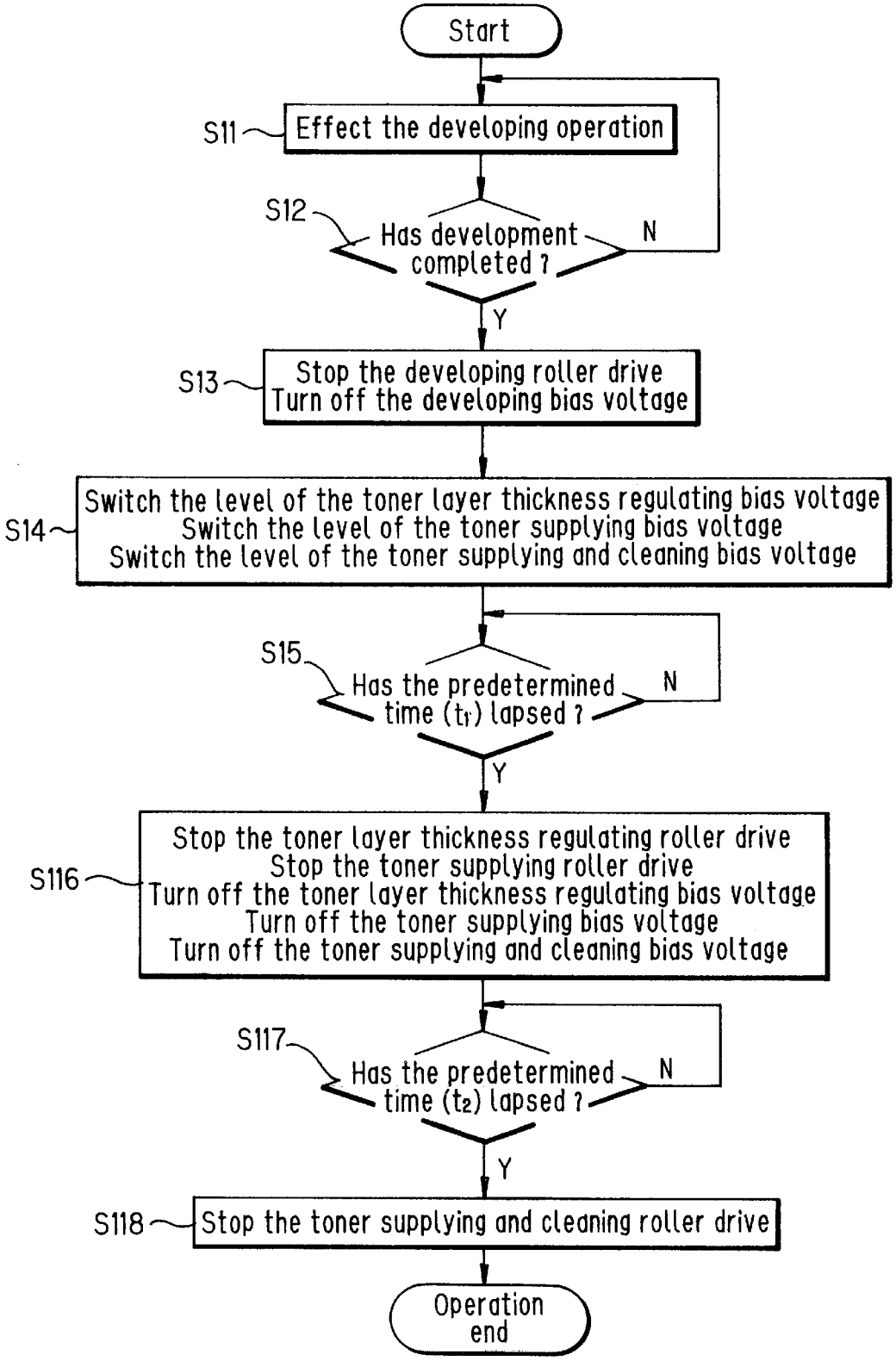
FIG. 14 is a control flowchart showing the control sequence of a developing device after the completion of development in a variational mode in accordance with the second embodiment of the present invention.

FIG. 14 shows the control sequence of the method and configuration. The control sequence shown in FIG. 14 is the same as that shown in FIG. 10 except in that the process of step S15 and those subsequent are different. Therefore, the control steps after Step S15 will be described in detail. The timing chart in this case is shown in FIG. 11B. Since the timing charts of the rollers other than that for the drive of cleaning roller 45 are the same as those shown in FIG. 11A, only the chart for the cleaning roller is shown.

In FIG. 14, developing device 4 operates for the image forming operation or particularly in harmony with the rotation of photoreceptor 1. In general, developing roller 41 starts rotating in response to the start of rotation of photoreceptor 1 to perform a developing operation. It is checked whether the developing operation is completed (S12). If it is confirmed, drive of developing roller 41 is stopped and application of developing bias voltage Va is turned off (S13).

In time with the end of the developing operation, the control sequence explained with reference to FIG. 10 is performed, and the lapse of the predetermined time t1 is waited. If the lapse of the time is confirmed, only cleaning roller 45 is kept rotating while rotation of supplying roller 42 and regulating roller 43 is stopped and application of the bias voltages to supplying roller 42, regulating roller 43 and cleaning roller 45 are turned off (OFF) at S116.

In the above way, controller 50 causes drive control circuit 52 to stop the drive of supplying roller 42 and regulating roller 43 and causes power control circuit 51 to stop voltage application to supplying roller 42, regulating roller 43 and cleaning roller 45.

It also checked whether time t2, which is longer than the above predetermined time t1, has elapsed from the end of development (S117). If the judgement is affirmative, rotation of cleaning roller 45 is stopped (S118) and the apparatus is set ready for a next image forming operation.

Thus, in accordance with the control of developing device 4 after Step S116 shown in FIG. 14, only cleaning roller 45 is kept on rotating after passage of the predetermined time t1 up to time t2, which is longer than t1, and then cleaning roller 45 is stopped at time t2. During this interval, cleaning roller 45 whilst rotating, though no bias voltage is applied thereto, as shown in FIG. 12C, removes the toner slightly remaining on its contact surfaces with supplying roller 42 and regulating roller 43, in a efficient manner. This beneficially removes toner 10 that tends to remain between cleaning roller 45 and supplying roller 42 or regulating roller 43, providing effective prevention against toner sticking.

It is preferred that this predetermined time t2 should be set so as to allow cleaning roller 45 to rotate at least one revolution after the passage of the predetermined time t1. That is, the predetermined time t1 plus the time required for cleaning roller 45 to make one revolution should be set as the predetermined time t2. Thus, making one revolution efficiently removes the toner from the entire peripheral surface of cleaning roller 45, further enhancing the prevention effect against toner sticking. Most preferably, the predetermined time t2 should be determined so as to allow cleaning roller 45 to make five or six revolutions after the passage of the predetermined time t1.

In the above embodiment of the present invention, the description has been made of the case where developing roller 41 is abutted on photoreceptor 1. However, the invention should not be limited to the device of this type but the present invention can also be applied as is to a non-contact type developing device in which developing roller 41 is arranged a certain distance away from photoreceptor 1.

The bias voltages applied to the individual rollers, the rotational rates for rotating them and the diameters of the rollers mentioned in the description of the embodiment of the present invention are mere example, and these can be modified appropriately aiming at the optimal performance. In particular, the bias voltages should be set so as to create an electric field that causes the toner charged with a particular polarity to move to the developing roller 41 side during development, as shown in FIG. 12A, and so as to create an electric field that causes the toner to move in reverse compared to that during development, during the period from the end of development up to the predetermined time t1. In this case, bias voltage Va applied to developing roller 41 should set at the lowest level in its absolute value compared to the levels of the other rollers 42, 43 and 45. For the other rollers, the levels of the bias voltages may be set at an equal level or the bias voltage Vb to regulating roller 43 may be the highest in terms of absolute value, with bias voltage Vd to cleaning roller 45 and bias voltage Vc to supplying roller 42 following in that order. The above setting of the bias voltages during development and after the end of development, makes the direction of movement of the toner in each mode opposite to that in the other mode.

The peripheral speed of cleaning roller 45 is set to be higher than that of regulating roller 43 and lower than that of supplying roller 42. This is to enhance the effect of cleaning regulating roller 43 and the effect of supplying the toner to supplying roller 42. Further, setting of the pressing force between cleaning roller 45 and regulating roller 43 to be greater than that between cleaning roller 45 and supplying roller 42 enhances the cleaning effect and the toner supplying effect. In this case, cleaning roller 45 can be formed of an elastic material such as rubber etc., instead of a hard material, so as to enhance the cleaning effect and the toner supplying function.

In accordance with the developing device for a mono component toner of the present invention, though the regulating roller and supplying roller are arranged in pressing contact with the developing member which supports the toner and conveys it to the developing position of the image bearer having a latent image, it is possible to efficiently prevent the toner residing between the rollers after the developing operation from sticking to the developing roller, regulating roller and/or supplying roller. This enables stable toner supply to the developing roller for a long period and hence realizes stable development for a long period of time.

In this case, simply, the potential difference between the bias voltages applied to the supplying roller and developing roller is switched from that during development to that after development. That is, the potential difference between the rollers should be controlled so as to create an electric field that will cause the toner to move toward the developing roller side during development and another electric field that will cause the toner to move in reverse or be attracted to the supplying roller side after the end of development. This simple control makes enhancement of the prevention effect against toner sticking to the developing roller.

Further, keeping on the above function after the end of development while the rotation of the developing roller is stopped, also enhances the prevention effect against toner sticking to the supplying roller and further improve the prevention effect against the toner sticking to the developing roller.

Keeping on the rotational drive of the regulating roller and supplying roller for a predetermined period of time after the end of development enables effective removal of the toner residing on the rollers, making it possible to produce the above effect.

Switching control of the bias voltages to the regulating roller and supplying roller weakens the toner's stickiness and hence improves the toner removal effect, realizing a further enhanced solution to the toner sticking problem.

Finally, the device for development using a mono component toner of the invention makes it possible to provide continuously stable development over the long term. This developing device can be applied to both the contact type where the developing member is put in contact with the static latent image bearer and the non-contact type where the developing member is kept out of contact with the bearer.

What is claimed is:

1. A mono component toner developing device, comprising:

a developing roller supporting and conveying the mono component toner to a developing area opposing a static latent image bearer;

a supplying roller for supplying the toner to the developing roller, as the preparative stage for facilitating the developing roller to convey the toner to the developing area; and, a controller which controls the bias voltages to the developing roller and supplying roller so that the potential difference therebetween during development creates an electric field that will cause the toner to move toward the developing roller side, switches the bias voltages, at the timing when the static latent image on the static latent image bearer is completely developed passing through the developing area, so that the polarity of the potential difference between the rollers becomes reversed compared to that during development, and keeps the potential difference during a predetermined period of time (t1) up to the rotation stop of the developing roller for terminating the developing operation;

wherein the controller stops rotation of the developing roller after a lapse of the predetermined time (t1), keeps up the drive of the supplying roller for a fixed period of time whilst maintaining the reversed state of the potential difference between the supplying roller and developing roller, and stops all the rollers and their voltage application after a lapse of the fixed time.

2. The mono component toner developing device according to claim 1, wherein the controller switches the bias voltage applied to the supplying roller from the voltage during development to such a voltage that the potential difference between the supplying roller and developing roller becomes reversed compared to that during development.

3. The mono component toner developing device according to claim 1, wherein the potential difference between the developing roller and supplying roller during development and that after the switching control following the development are set to be lower than the discharge starting voltage.

4. A mono component toner developing device, comprising:

a developing roller supporting and conveying the mono component toner to a developing area opposing a static latent image bearer;

a supplying roller for supplying the toner to the developing roller, as the preparative stage for facilitating the developing roller to convey the toner to the developing area; and, a controller which controls the bias voltages to the developing roller and supplying roller so that the potential difference therebetween during development creates an electric field that will cause the toner to move toward the developing roller side, switches the bias voltages, at the timing when the static latent image on the static latent image bearer is completely developed passing through the developing area, so that the polarity of the potential difference between the rollers becomes reversed compared to that during development, and keeps the potential difference during a predetermined period of time (t1) up to the rotation stop of the developing roller for terminating the developing operation;

wherein the predetermined time (t1) is set so as to at least allow the developing roller to rotate more than one revolution.

5. A mono component toner developing device, comprising: a developing member (roller) supporting and conveying the mono component toner to a developing area opposing a static latent image bearer;

a supplying roller for supplying the toner to the developing roller, as the preparative stage for facilitating the developing roller to convey the toner to the developing area;

a regulating roller for limiting the toner supplied to the developing roller to a constant amount before the toner reaches the developing area;

a cleaning roller disposed in contact with the supplying roller and the regulating roller; and a controller which stops the developing member after the static latent image on the static latent image bearer has been developed whilst keeping on the rotation of supplying roller, regulating roller and cleaning roller for a predetermined period of time, and switches the levels of the bias voltages, in time with the stop control of the developing member so that the directions of the electric fields acting on the toner, formed at least between the developing member and the supplying roller and between the developing member and the regulating roller after switching are opposite to those formed during development.

6. The mono component toner developing device according to claim 5, wherein the controller switches the level of the bias voltage applied to the cleaning roller so that the directions of the electric fields acting on the toner, formed between the supplying roller and the cleaning roller and between the regulating roller and the cleaning roller after switching are opposite to those formed during development.

7. The mono component toner developing device according to claim 5 or 6, wherein upon the switching control of the bias voltages, the controller regulates the potential differences to be equal to or lower than the discharge starting voltage.

8. The mono component toner developing device according to claim 5, wherein the controller stops rotation of the supplying roller and regulating roller after a lapse of the predetermined period of time and keeps on controlling and driving only the cleaning roller for a predetermined period of time.

9. The mono component toner developing device according to claim 8, wherein the controller turns off the application of voltages to the supplying roller and the regulating roller, or the application of voltages to the above two rollers and the cleaning roller, after a lapse of the predetermined period of time.

10. The mono component toner developing device according to claim 5, wherein the predetermined time is set so as to at least allow the supplying roller, regulating roller and cleaning roller to rotate more than one revolution.

* * * * *